US011752793B2

(12) United States Patent
El-Karzazi et al.

(10) Patent No.: US 11,752,793 B2
(45) Date of Patent: Sep. 12, 2023

(54) HEAT-SENSITIVE RECORDING MATERIAL

(71) Applicant: Mitsubishi HiTec Paper Europe GmbH, Bielefeld (DE)

(72) Inventors: Nadia El-Karzazi, Bielefeld (DE); Claas Boxhammer, Herford (DE)

(73) Assignee: MITSUBISHI HITEC PAPER EUROPE GMBH, Bielefeld (DE)

( * ) Notice: Subject to any disclaimer, the term of this patent is extended or adjusted under 35 U.S.C. 154(b) by 432 days.

(21) Appl. No.: 16/966,323

(22) PCT Filed: Jan. 31, 2019

(86) PCT No.: PCT/EP2019/052349
§ 371 (c)(1),
(2) Date: Jul. 30, 2020

(87) PCT Pub. No.: WO2019/149806
PCT Pub. Date: Aug. 8, 2019

(65) Prior Publication Data

US 2020/0369062 A1 Nov. 26, 2020

(30) Foreign Application Priority Data

Jan. 31, 2018 (DE) ..... 10 2018 102 180.0

(51) Int. Cl.
*B41M 5/333* (2006.01)
*B41M 5/42* (2006.01)
(Continued)

(52) U.S. Cl.
CPC ..... *B41M 5/3333* (2013.01); *B41M 5/3275* (2013.01); *B41M 5/426* (2013.01);
(Continued)

(58) Field of Classification Search
CPC ..... B41M 5/3275; B41M 5/3333; B41M 5/3377; B41M 5/426; B41M 5/443; B41M 2205/04; B41M 2205/38; B41M 2205/40
See application file for complete search history.

(56) References Cited

U.S. PATENT DOCUMENTS 6,242,167 B1 6/2001 Shackle et al.
2002/0006869 A1* 1/2002 Tajiri ..... B41M 5/3333 503/216
(Continued)

FOREIGN PATENT DOCUMENTS

CN 1946566 4/2007
CN 101090831 12/2007
(Continued)

OTHER PUBLICATIONS

Machine translation of JP 2014-172195 acquired on Dec. 12, 2022.*
(Continued)

*Primary Examiner* — Gerard Higgins
(74) *Attorney, Agent, or Firm* — Cozen O'Connor

(57) ABSTRACT

A heat-sensitive recording material including a substrate, a heat-sensitive recording layer which includes N-(4-methylphenylsulfonyl)-/V-(3-(4-methylphenylsulfonyloxy) pheny-purea and/or N42-(3-phenylureido)phenyl]benzol sulfonamide, and an intermediate layer which is arranged between the substrate and the heat-sensitive recording layer and which includes calcined aluminum silicate, and a method for producing a heat-sensitive recording material and to the use of calcined aluminum silicate in an intermediate layer of a heat-sensitive recording material.

29 Claims, 7 Drawing Sheets

(51) Int. Cl.
*B41M 5/327* (2006.01)
*B41M 5/44* (2006.01)

(52) U.S. Cl.
CPC ..... *B41M 5/443* (2013.01); *B41M 2205/04* (2013.01); *B41M 2205/38* (2013.01); *B41M 2205/40* (2013.01)

(56) References Cited

U.S. PATENT DOCUMENTS

| | | | |
|---|---|---|---|
| 2005/0148467 A1 | 7/2005 | Makitalo et al. | |
| 2006/0118664 A1 | 6/2006 | Sare et al. | |
| 2008/0076663 A1* | 3/2008 | Yoneshige | B41M 5/3377 503/209 |

FOREIGN PATENT DOCUMENTS

| | | |
|---|---|---|
| CN | 104995033 | 10/2015 |
| CN | 106536209 | 3/2017 |
| CN | 107107642 | 8/2017 |
| CN | 107250107 | 10/2017 |
| DE | 102004004204 | 8/2005 |
| DE | 102014107567 | 11/2015 |
| DE | 102015104306 | 9/2016 |
| DE | 102016219091 | 4/2017 |
| DE | 102016219569 | 4/2018 |
| EP | 1140515 | 9/2004 |
| EP | 1738920 | 1/2007 |
| EP | 1800888 | 6/2007 |
| EP | 1832434 | 9/2007 |
| EP | 1925459 | 5/2008 |
| EP | 2765007 | 8/2014 |
| EP | 2923851 | 9/2015 |
| JP | 2002-160461 | 6/2002 |
| JP | 2004-284262 | 10/2004 |
| JP | 2005-088223 | 4/2005 |
| JP | 2005-262714 | 9/2005 |
| JP | 2006-524175 | 10/2006 |
| JP | 2007-069460 | 3/2007 |
| JP | 2009-234068 | 10/2009 |
| JP | 2012-218311 | 11/2012 |
| JP | 2012-245666 | 12/2012 |
| JP | 2014-172195 | 9/2014 |
| JP | 2014218062 | 11/2014 |
| JP | 2015-013470 | 1/2015 |
| JP | 2015-150764 | 8/2015 |
| JP | 2015-157478 | 9/2015 |
| JP | 2017-177346 | 10/2017 |
| WO | WO 2006/035567 | 4/2006 |
| WO | WO 2014/143174 | 9/2014 |
| WO | WO 2016136203 | 8/2016 |
| WO | WO 2018/065328 | 4/2018 |
| WO | WO 2018/211063 A2 | 11/2018 |

OTHER PUBLICATIONS

Machine translation of JP 2004-284262 acquired on Dec. 12, 2022.*
Office Action dated May 23, 2022 issued in European Patent Application No. 19702871.5.
Office Action dated May 24, 2022 issued in Japanese Patent Application No. 2020-541897.
Office Action of the corresponding German Patent Application No. 10 2018 102 180.1.
Slepetys et al. "Determination of Shape of Kaolin Pigment Particles" Clay Minerals, 1993, pp. 495-508.
"Pigment-Volumen-Konzentration", Wikipedia, Jul. 26, 2016.
"Kaolin" Wikipedia, Oct. 28, 2017.
DIN 53107 "Testing Of Paper And Board—Determination of The Smoothness By The Bekk Method", May 2016.
Din En Iso 787-5 "General Methods of Test For Pigments And Extenders—Part 5: Determination of Oil Absorption Value", Oct. 1995.
Office Action dated Jul. 23, 2021 issued in Chinese Patent Application No. 201980011166.4.
Office Action dated Dec. 8, 2022 issued in Japanese Patent Application No. 2020-541897.

* cited by examiner

| | 90°C resistances |
|---|---|
| Comp. example 1 |  |
| Inv. example 1 |  |
| Inv. example 2 |  |

HEAT-SENSITIVE RECORDING MATERIAL

CROSS REFERENCE TO RELATED APPLICATIONS

This is a U.S. national stage of Application No. PCT/EP2019/052349 filed Jan. 31, 2019. Priority is claimed on German Application No. DE 10 2018 102 180.1 filed Jan. 31, 2018 the content of which is incorporated herein by reference.

BACKGROUND OF THE INVENTION

1. Field of the Invention

The present invention relates to a heat-sensitive recording material, comprising a substrate, a heat-sensitive recording layer, comprising N-(4-methylphenylsulfonyl)-N'-(3-(4-methylphenylsulfonyloxy)phenyl)urea and/or N-[2-(3-phenylureido)phenyl]benzenesulfonamide, and an interlayer disposed between the substrate and the heat-sensitive recording layer that comprises calcined aluminum silicate. The present invention further relates to a method for producing a heat-sensitive recording material and also to the use of calcined aluminum silicate in an interlayer of a heat-sensitive recording material.

2. Description of Related Art

Heat-sensitive recording materials have been known for many years and are enjoying a great popularity. One of the reasons for this popularity is that their use entails the advantage that the color-forming components are contained in the recording material itself and it is therefore possible to use printers that are free of toner and ink cartridges. There is therefore no longer any need for toner or ink cartridges to be purchased, stored, and replaced or refilled. Accordingly, this innovative technology has become established comprehensively in public transportation and in retail, in particular, Recently, however, there have been increased concerns with regard to the environmental compatibility especially of certain (bis)phenolic color developers, also called color acceptors, and in some cases of dye precursors as well, these being the components with which the color developers react on supply of heat to form a visually perceptible color, and these concerns can no longer be disregarded by the industry and especially by the trade. Recently, then, among the color developers, for example, the well-known components bisphenol A, i.e., 2,2 bis(4-hydroxyphenyl)propane, and bisphenol S, i.e., 4,4'-dihydroxydiphenyl sulfone, which have been exceptionally well studied scientifically, have come under a spotlight of increased public criticism and are therefore sometimes replaced by

- N-(4-methylphenylsulfonyl)-N'-(3-(4-methylphenylsulfonyloxy)phenyl)urea, also known as Pergafast 201, which is sold by BASF SE;
- 4-hydroxy-4'-isopropoxydiphenyl sulfone, also known as "D8"; and
- N-[2-(3-phenylureido)phenyl]benzenesulfonamide, also known as "NKK".

With the aim of improving heat-sensitive recording materials particularly in the context of their use as entry or lottery tickets and in terms of their resistance to environmental effects such as heat, humidity, and chemicals, there has been continual ongoing development in the underlying chemistry and the production technology for producing such recording materials.

To enhance the resistance of a thermal printout available from a heat-sensitive recording material (heat-induced recording) with respect to water, aqueous alcohol solutions, and plasticizers, DE 10 2004 004 204 A1 proposes a heat-sensitive recording material whose heat-sensitive recording layer comprises customary dye precursors and also the combination of a phenolic color developer and a urea-urethane-based color developer.

DE 10 2015 104 306 A1 describes a heat-sensitive recording material that comprises a carrier substrate and also a heat-sensitive, color-forming layer comprising at least one color former and at least one phenol-free color developer, the phenol-free color developer used being, for example, N-phenyl-N'-[(phenylamino)sulfonyl]urea, N-(4-methylphenyl)-N'-[(4-ethylphenylamino)sulfonyl]urea, N-(4-ethoxycarbonylphenyl)-N-'-[(4-ethoxycarbonylphenylamino)sulfonyl]urea, or compounds of similar structure.

JP 2014-218062 A describes a heat-sensitive recording material having a heat-sensitive recording layer that comprises at least one leuco dye and a color developer on a carrier. The color developer used is a mixture of 4,4'-bis(3-tosylureido)diphenylmethane and N-[2-(3-phenylureido)phenyl]benzenesulfonamide.

International patent application WO 2016/136203 A1 describes a crystalline form of N-[2-(3-phenylureido)phenyl]benzenesulfonamide and the use of this crystalline form in a recorded material. The crystalline form is characterized by statement of reflections in the x-ray powder diffractogram or diffraction diagram and by the melting point, and is thereby distinguished is from other crystalline forms of this compound. It is additionally mentioned that the crystalline forms can likewise be differentiated from one another by means of the absorption bands in the IR spectrum. It is also shown that different crystalline forms of a compound can lead to different properties on the part of the recording materials produced using this compound.

The subject of US 2005/0148467 A1 is a heat-sensitive recording material which in order to form an irreversible printed image comprises at least the components of two color-forming systems, with one system being of the chelate type and the other being a conventional leuco dye system.

SUMMARY OF THE INVENTION

There exists an ongoing need for further heat-sensitive recording materials for a wide variety of different utilities; owing to the high sales volume in a vigorously fought-over market, these materials must be able to be produced at low production costs and must therefore have a simple structure. Another challenge lies in the fact that a printed heat-sensitive recording material is exposed to a multiplicity of different ambient influences, such as humidity, heat or chemicals, in the course of its typical uses as a ticket, entry ticket, travel warrant, parking warrant, and the like.

For instance, in the course of their normal use, heat-sensitive recording materials may come into contact with a host of different substances that can influence the resistance of the thermal printout. Besides water and organic solvents, these substances also include fats and oils, which are contained, for example, in hand care products and which may be transferred to the heat-sensitive recording material on contact with it. The resistance toward fats and oils in particular is therefore very relevant.

In addition to the resistance to chemicals, which may enter into contact with the heat-sensitive recording materials, these materials must also have a high resistance to thermal influences and to the inward radiation of light. On one hand, the heat-sensitive recording material should be able to be printed easily and with little energy, so that little energy is consumed, for example, in the case of mobile applications. On the other hand, the printed image ought to last after printing, and the action of heat or of light should cause neither the printed image to fade nor the unprinted background to discolor, resulting in the print ceasing to be legible. Parking display tickets which, once printed, are displayed behind the windshield and thereby become exposed in the summer to high temperatures and direct sunlight, are an example of where thermal resistance and resistance to light are very much relevant.

With tickets such as concert tickets or flight tickets as well, which are frequently produced a long time in advance, or with receipts or proofs of purchase, which are needed to demonstrate purchase over a long guarantee period, the long-term resistance of the heat-sensitive recording material is very important. Particularly if the assumption must be that the heat-sensitive recording materials may come into contact with moisture, as a result, for example, of being kept close to the body (e.g., in a pants pocket) when they are used as a concert ticket, flight ticket, or till receipt, and may hence come into contact with perspiration, it is necessary to ensure that the recording materials remain highly legible even after contact with moisture.

There is therefore an ongoing demand for improvement in the resistance of the thermal printout to various ambient influences. One aspect of the present invention, therefore, is a heat-sensitive recording material which in the printed state exhibits improved resistance toward ambient influences such as daylight and heat, while at the same time ideally having very good printability.

Further objects are apparent from the description below and from the claims.

The subject matter of aspects of the invention is defined in the appended claims and in the description below.

One aspect of the invention is a heat-sensitive recording material comprising or consisting of:

a substrate, having a front side and a reverse side opposite the front side, a heat-sensitive recording layer disposed to the front side of the web-form substrate, the heat-sensitive recording layer comprising at least one dye precursor and at least one color developer that is reactive with the dye precursor and which a) is a compound of the formula (I) depicted below (I)

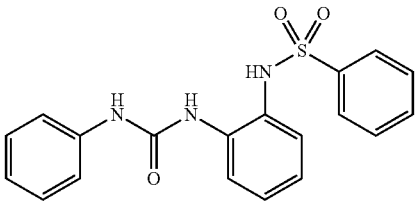

or b) is a compound of the formula (II) depicted below (II)

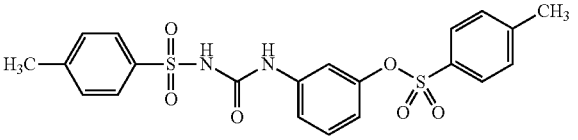

or c) is a mixture comprising the compound of the formula (I) and the compound of the formula (II)

and an interlayer disposed between the substrate and the heat-sensitive recording layer and comprising calcined aluminum silicate, the mass fraction of the calcined aluminum silicate in the interlayer being 50 to 90%, based on the total mass of the solids fractions in the interlayer.

Surprisingly it has emerged that heat-sensitive recording materials of the invention exhibit increased daylight resistance. In in-house studies it has emerged, moreover, that the optical print density or stability of the printed heat-sensitive recording material is improved. A further positive and unexpected effect is that it has also been possible to improve the contrast between printed areas and unprinted areas (background) of the heat-sensitive recording material and that the contrast exhibits high stability.

It has surprisingly emerged, moreover, that with heat-sensitive recording materials of one aspect of the invention, it has been possible to improve the dynamic print density, so enabling a greater print density (blackness) for a defined amount of energy acting on the heat-sensitive recording material.

It has also emerged, surprisingly, that the maximum print density (Dmax) is higher in the case of recording materials of one aspect of the invention, hence allowing a deeper black to be obtained in the printed region.

In-house studies have likewise shown that through the use of calcined aluminum silicate in heat-sensitive recording materials of one aspect of the invention, it is possible to achieve a significant reduction in the smearing of the printed image in the unprinted region (e.g., "tailing" or "bleeding") or even to avoid such smearing entirely, especially by comparison with heat-sensitive recording materials which have, as pigments, organic hollow-body pigments in the interlayer. Here, "tailing" describes a smearing of the printed image in the processing direction, and "bleeding" an undirected smearing of the printed image starting from a central point or center.

These results are surprising in light of the assumption hitherto that to improve the properties of the heat-sensitive recording material it is necessary for the components of the heat-sensitive recording layer to be varied and/or optimized. In the prior art cited above, for example, only the components of the heat-sensitive recording layer have been varied to obtain improved properties. The assumption had so far always been that the composition of the interlayer has no influence on the properties of the heat-sensitive recording layer located thereon and that inorganic pigments were interchangeable, without any significant alteration in the properties of the heat-sensitive recording layer or of the resultant heat-sensitive recording material. Only with the use of hollow-body pigments in the interlayer was an improvement known in the response characteristics of the heat-sensitive recording material. The explanation given for this was that hollow-body pigments, containing air in their interior, have a high heat reflection capacity and consequently the resultant interlayer represents a good thermal insulator. Accordingly, the interlayer optimized with hollow-body pigments as a heat reflection layer very specifically increases the response characteristics of the recording layer with respect to heat. Hence it is all the more surprising that heat-sensitive recording materials of the invention have a higher dynamic print density, a higher maximum print density (Dmax), and a higher light stability than materials using hollow-body pigments in the interlayer, instead of calcined aluminum silicate.

According to one aspect of the present invention it is advantageous that the compound with the formula (I) is used as color developer and the compound with the formula (II) is not present in the heat-sensitive recording layer. In other embodiments of the present invention, alternatively, it is advantageous that the compound of the formula (II) is used as color developer and the compound of the formula (I) is not present in the heat-sensitive recording layer.

Where a mixture comprising the compound of the formula (I) and the compound of the formula (II) is used as color developer, it has proven particularly advantageous if the compound of the formula (I) is in a crystalline form which in the IR spectrum has an absorption band at 3401±20 $cm^{-1}$.

The combination of (A) the developers of the formula (I), of the formula (II) or mixtures thereof, used in the invention, and (B) calcined aluminum silicate in the interlayer has a synergistic effect, which means that the resultant heat-sensitive recording materials have improved properties.

The compound having the formula (I) is the existing compound N-[2-(3-phenylureido)phenyl]benzenesulfonamide, which is described for example in EP 2 923 851 A1. It is sold under the name NKK.

The compound having the formula (II) is the existing compound N-(4-methylphenylsulfonyl)-N-(3-(4-methylphenylsulfonyloxy)phenyl)urea, which is sold under the name Pergafast 201 and is described for example in EP 1 140 515 B1. Pergafast 201 is the phenol-free color developer that is presently the most frequently used.

In in-house studies it has emerged that the compound of the formula (I) can be present in two different crystalline forms. The two crystalline forms have different physical properties, which may have effects on the heat-sensitive recording material.

One crystalline form of the compounds having the formula (I) has a melting point of around 158° C., whereas the second crystalline form of the compounds having the formula (I) has a melting point of 175° C. In connection with heat-sensitive recording materials, the only description in the literature to date has been of the compound with the formula (I), which is the crystalline form having a melting point of around 158° C. (cf. for example, EP 2 923 851 A1, paragraph [0084]). Neither the preparation nor the use of the crystalline form of the compounds having the formula (I) with a melting point of around 175° C. have hitherto been described in the literature. It must therefore be assumed that it was always the crystalline form of the compound having the formula (I) with a melting point of around 158° C. that was used, although the melting point is not explicitly mentioned in the document in question. The crystalline form of the compound of the formula (I) having a melting point of 175° C. has recently become available commercially as well.

Preferred in the invention is a heat-sensitive recording material wherein the crystalline form of the compound of the formula (I) exhibits a (preferably endothermic) transition at a temperature between 170° C. and 178° C., preferably between 173° C. and 177° C., more preferably between 174° C. and 176° C., determined by means of dynamic scanning calorimetry (DSC) at a heating rate of 10 K/min.

The two crystalline forms of the compounds having the formula (I) may likewise be distinguished from one another in the IR absorption spectrum. Particularly characteristic in the case of the crystalline form of the compounds having the formula (I), used in one aspect of the invention, is an absorption band in the IR spectrum at 3401±20 $cm^{-1}$. In the case of the crystalline form of the compounds having the formula (I) that has a melting point of around 158° C., this band is absent, there being instead a band at each of 3322 and 3229 $cm^{-1}$.

Preferred in one aspect of the invention is a heat-sensitive recording material wherein the compound of the formula (I) is in a crystalline form which in the IR spectrum has an absorption band at 3401±20 $cm^{-1}$.

In-house studies have shown that both crystalline forms of the compound having the formula (I) can be used. However, the resulting heat-sensitive recording materials have slightly different properties. Although an improvement in the dynamic print density, the maximum print density (Dmax), and the light stability in heat-sensitive recording materials of the invention can be achieved for both crystalline forms, it has emerged that heat-sensitive recording materials for which the compound of the formula (I) is in a crystalline form which in the IR spectrum has an absorption band at 3401±20 $cm^{-1}$ or has a melting point of around 175° C. exhibit slightly improved properties by comparison with heat-sensitive recording materials for which the compound of the formula (I) is in the other crystalline form.

In-house studies have nevertheless shown that recording materials for which the compound of the formula (I) is in a crystalline form which in the IR spectrum has two absorption bands at 3322±5 and 3229±5 $cm^{-1}$ or has a melting point of around 158° C. exhibit a slightly increased stability toward grease (lanolin) and ethanol and on storage at high atmospheric humidity at 40° C. Where a high stability toward greases, such as lanolin and/or solvents, such as ethanol, is desirable or where resistance under high atmospheric humidity is required, it is preferable to use the crystalline form of the compound of the formula (I) which in the IR spectrum has two absorption bands at 3322±5 and 3229±5 $cm^{-1}$ or has a melting point of around 158° C.

One embodiment of the heat-sensitive recording material of one aspect of the invention comprises as developer a mixture of the compound of the formula (I) and the compound of the formula (II).

The skilled person is aware that the combination of different developers, such as compounds of the formula (I) or (II), leads typically to a deterioration in the properties of the heat-sensitive recording material. The combination of two or more developers typically leads to an unwanted change in the color of the heat-sensitive recording material, causing the heat-sensitive recording material to have a gray effect, for example, without improving the other properties. Therefore, in an attempt to provide a heat-sensitive recording material which in the printed state has high resistance to ambient influences, such as moisture, heat or chemicals, the skilled person would not have contemplated combining different developers with one another and would not have carried out experiments to that effect. For this reason, the embodiment of the solution of the invention shown here is surprising, since the skilled person, in order to achieve the object, had first to overcome the technical prejudice that two developers shall not be combined with one another.

In one aspect of the invention, preference is given to a heat-sensitive recording material wherein the mass ratio between the compound of the formula (I) and the compound of the formula (II) is 0.5:99.5 to 99.5:0.5. In in-house studies it has emerged that for a mass fraction of less than 0.5% of the compound having the formula (I) or (II), based on the total mass of the compounds having the formula (I) and (II), the positive influence of the respective compound is not so sharply pronounced.

According to one aspect of the invention, particular preference is given to a heat-sensitive recording material wherein the mass ratio between the compound of the formula (I) and the compound of the formula (II) is 35:65 to 65:35, preferably 40:60 to 60:40, more preferably 45:55 to 55:45.

In in-house studies it has emerged that mixtures having a mass ratio between the compound of the formula (I) and the compound of the formula (II) of around 1:1 or in the above-defined ranges of 35:65 to 65:35, preferably 40:60 to 60:40, more preferably 45:55 to 55:45 exhibit a synergistic effect in relation both to improved long-term stability and to improved resistance to lanolin. Heat-sensitive recording materials which as a color developer mixture comprise mixtures having these mass ratios, i.e., mixtures having equal to near-equal mass fractions of the compounds of the formula (I) and (II), display better properties than heat-sensitive recording materials for which the color developer mixture has been replaced in equal parts by mass by only one compound of the formula (II) or (I).

In relation to the resistance at high temperatures (60° C.) specifically, it has emerged that the printed image of heat-sensitive recording materials of the invention for which the mass ratio between the compound of the formula (I) and the compound of the formula (II) is 0.5:99.5 to 35:65, even after storage for 24 hours at 60° C., decreases less than for heat-sensitive recording materials for which the color developer mixture has been replaced in equal parts by mass by a compound of the formula (I). In some cases the printed image of heat-sensitive recording materials of the invention after storage at 60° C. for 24 hours has a higher print density than for heat-sensitive recording materials for which the color developer mixture has been replaced in equal parts by mass by a compound of the formula (I) or (II). The combination, used in one aspect of the invention, of a compound of the formula (I) with a compound of the formula (II) therefore has a synergistic effect which was not foreseeable and is therefore entirely surprising.

In one aspect of the present invention, preference is given to a heat-sensitive recording material wherein the mass ratio between the compound of the formula (I) and the compound of the formula (II) is 5:95 to 30:70, preferably 15:85 to 25:75.

In in-house studies it has emerged that mixtures having a mass ratio between the compound of the formula (I) and the compound of the formula (II) of around 20:80 or in the above-defined ranges from 5:95 to 30:70, preferably 15:85 to 25:75, have a synergistic effect in terms of improved resistance at 60° C. for at least 24 hours. Heat-sensitive recording materials, which comprise as developer mixtures having these mass ratios display better stabilities at 60° C. than heat-sensitive recording materials for which the color developer mixture has been replaced in equal parts by mass by only one compound of the formula (II) or (I).

In a further aspect of the present invention, preference in the invention is given to a heat-sensitive recording material wherein the mass ratio between the compound of the formula (I) and the compound of the formula (II) is 97:3 to 85:15, preferably 95:5 to 90:10.

In in-house studies it has emerged that mixtures having a mass ratio between the compound of the formula (I) and the compound of the formula (II) of around 93:7 or in the above-defined ranges from 97:3 to 85:15, preferably 95:5 to 90:10, have particularly good properties in relation to the resistance at 40° C. and high atmospheric humidity for at least 24 hours and an improved resistance to grease (especially lanolin). Heat-sensitive recording materials which comprise as developer mixture mixtures having these mass ratios display better properties (moisture resistance or grease resistance) than heat-sensitive recording materials for which the developer mixture has been replaced in equal parts by mass by only one compound of the formula (II) or (I).

Commercially available lanolin represents a mixture which is obtained, for example, according to the German Pharmacopeia 10 (DAB 10), by melting 65 mass fractions of lanolin, 20 mass fractions of water, and 15 mass fractions of viscous paraffin together. By kneading it is possible to incorporate a further 100 mass fractions of water without any change in the external appearance. Lanolin (wool wax, wool grease, adeps lanae, INCI name: Lanolin, E 913) is secreted by the sebaceous glands of the sheep. It is got by extracting of oleum fleeces with isopropanol. The name lanolin derives from the Latin lana for wool and oleum for oil.

Surprisingly it has emerged that in heat-sensitive recording materials of one aspect of the invention for which the mass ratio between the compound of the formula (I) and the compound of the formula (II) is 99.5:0.5 to 65:35, no graying of the unprinted recording material is to be observed. Especially in the case of a mass ratio between the compound of the formula (I) and the compound of the formula (II) of 99:1 to 75:25, there is no relevant graying of the unprinted recording material. This mixing ratio is therefore preferred.

Depending on the anticipated influences acting on the thermal paper, therefore, the properties of the resultant heat-sensitive recording material can be optimized to the intended application through adjustment of the mixing ratio between the compound of the formula (I) and the compound of the formula (II). For instance, requirements imposed on heat-sensitive recording materials which are to be used as parking display tickets are different from those of materials intended for use as concert tickets. By combining the mixture of the compounds of the formula (I) and of the formula (II) with calcined aluminum silicate in the interlayer, these optimized properties may even be improved still further.

In one aspect of the heat-sensitive recording material of the invention, the developer is the compound of the formula (I), with no compound of the formula (II) present.

It is preferred in one aspect of the invention if the heat-sensitive recording layer has a Bekk smoothness, determined according to DIN 53107:2016-05 (Title: Testing of Paper and Board—Determination of the smoothness by the Bekk method), of 100 to 1200 seconds, preferably of 150 to 1100 seconds.

In-house studies have shown that if the heat-sensitive recording layer is present as outer layer and has a Bekk smoothness of 100 to 1200 seconds or preferably of 150 to 1100 seconds, the heat-sensitive recording materials have particularly good properties. The high smoothness of the heat-sensitive recording material has the advantage—among others—of preserving the thermal head of the thermal printer. Moreover, smooth heat-sensitive recording materials have particularly good tactility and visual appearance and led themselves particularly well to printing.

As already observed early on above, heat-sensitive recording materials of aspects of the invention display improved resistance, relative to the prior art, with respect to light, and an improved contrast. Here it has emerged that heat-sensitive recording materials of the invention in which the compound of the formula (I) is present as developer have a higher resistance to light, better contrast, and a higher maximum print density (Dmax) than heat-sensitive recording materials of the invention in which the compound of the formula (II) is present as developer.

It has likewise emerged that heat-sensitive recording materials of one aspect of the invention in which the compound of the formula (I) is present as developer exhibit no background graying after storage at 90° C. for at least 24 hours.

In an embodiment preferred according to one aspect of the invention, the calcined aluminum silicate in the interlayer is platelet-shaped. In-house studies comparing nonplatelet aluminum silicate with platelet-shaped aluminum silicate have surprisingly shown that the use of platelet-shaped, calcined aluminum silicate leads to particularly good properties on the part of the heat-sensitive recording material. When platelet-shaped calcined aluminum silicate is used in the interlayer, the individual platelets of the aluminum silicate become arranged one above another with an offset, resulting in a very dense layer structure. Calcined aluminum silicate which is not platelet-shaped does not develop these layer structures. Nonplatelet calcined aluminum silicate may be obtained, for example, by grinding platelet-shaped calcined aluminum silicate or by appropriate setting of the production parameters. The term platelet-shaped (also called flake-shaped or flakelike) refers to particles whose diameter is substantially greater than their thickness.

It is particularly preferred in one aspect of the invention if the platelet-shaped, calcined aluminum silicate has a (preferably average) aspect ratio of 3 to 100, preferably of 5 to 95, especially preferably of 10 to 90. In one preferred aspect the (preferably average) aspect ratio of the inorganic pigment is greater than 15. The aspect ratio (also called shape factor) is the quotient formed between the diameter and the thickness of the platelet of the inorganic pigment prior to mixing with the other components. An aspect ratio of 15 means that the diameter of the platelet is 15 times greater than the thickness of the platelet.

In one preferred embodiment of the recording material of one aspect of the invention, 85 to 93% of the calcined aluminum silicate particles used to produce the interlayer have a particle size as determined by x-ray granulometry of less than or equal to 2 μm.

In-house studies have shown that these calcined aluminum silicate particles are especially well suitable for producing interlayers used in the invention.

In one preferred embodiment of the recording material of one aspect of the invention, the calcined aluminum silicate used has a brightness (also known as white content or lightness) of greater than or equal to 85%, preferably greater than or equal to 90%, more preferably of greater than or equal to 92%.

It is particularly advantageous if the calcined aluminum silicate in the interlayer has an oil absorption value of at least 80 $cm^3$/100 g and even better of 100 $cm^3$/100 g, determined according to DIN EN ISO 787-5:1995-10 (Title: General Methods of Test for Pigments and Extenders—Part 5: Determination of oil absorption value (ISO 787-5:1980); German version EN ISO 787-5:1995).

In in-house studies it has surprisingly emerged that the high mass fraction of calcined aluminum silicate of more than 50% in recording materials of the invention leads to particularly good properties.

It is preferred in one aspect of the invention if the mass fraction of the calcined aluminum silicate in the interlayer is 60 to 89%, preferably 70 to 88%, based on the total mass of the solids fractions in the interlayer.

It is further preferred in one aspect of the invention if the mass fraction of the calcined aluminum silicate in the interlayer is 80 to 87%, preferably 83 to 87%, based on the total mass of the solids fractions in the interlayer.

In-house studies have shown that the heat-sensitive recording materials have particularly good properties—in particular, little or no smearing of the printed image into the unprinted region, high daylight and heat-sensitive recording materials resistance, high sensitivity, and high maximum print density (Dmax)—if the mass fraction of the calcined aluminum silicate is within the limits specified above. An optimum value has been found at a mass fraction of the calcined aluminum silicate of around 86%. With a mass fraction of more than 90%, there is no longer any significant reduction in the smearing of the printed image, but there is a sudden deterioration in the further properties of the heat-sensitive recording material. The deterioration in the properties can be explained on the one hand by a sharp deterioration in the binding force of the interlayer. It has emerged that when calcined aluminum silicate is used in the interlayer, with a mass fraction of more than 90%, the aluminum silicate particles can no longer be held together sufficiently and a possible outcome is the detachment or tearing of the interlayer. This detachment may lead to a deterioration in the printed image and to deposits on the print head. Deposits on the print head may lead to the print head being defective or to further deterioration of the printed image. Moreover, a mass fraction of more than 90% of calcined aluminum silicate in the interlayer means that, because of the high open porosity of the interlayer, the binder of the heat-sensitive recording layer is partly absorbed by the interlayer during the production of the heat-sensitive recording material, and is no longer available to bind the heat-sensitive recording layer. In order to compensate for this absorption of the binder, it is necessary to increase the binder content of the coating composition used for producing the heat-sensitive recording layer. This increase in the binder content, however, leads to a deterioration in the print sensitivity and the maximum print density.

In one aspect of the invention if the mass fraction of the calcined aluminum silicate in the interlayer is 60 to 79%, preferably 65 to 75%, based on the total mass of the solids fractions in the interlayer.

In one preferred embodiment of the heat-sensitive recording material of one aspect of the invention there are no organic or inorganic pigments other than the calcined aluminum silicate.

In certain embodiments, however, it may also be preferable if as well as the calcined aluminum silicate there are also other inorganic or organic pigments in the interlayer. Besides organic pigments, which are preferably in the form of organic hollow-body pigments, the interlayer may also comprise further inorganic pigments, in which case the inorganic pigments are selected individually or in combination with one another from the list encompassing natural kaolin, silicon oxide and here especially bentonite, calcium carbonate, and also aluminum oxyhydroxides and here especially boehmite.

Preferred in one aspect of the invention is a heat-sensitive recording material wherein the interlayer further comprises one or more constituents selected from the group consisting of biocides, binders, dispersants, release agents, defoamers, thickeners, and optical brighteners. According to one aspect of the invention, the at least one dispersant is a sodium polyacrylate homopolymer.

Preferred in one aspect of the invention is a heat-sensitive recording material wherein the interlayer, besides the calcined aluminum silicate and optionally besides the further inorganic and/or organic pigments, comprises at least one binder, preferably based on a synthetic polymer, with styrene-butadiene latex yielding particularly good results. The use of a synthetic binder with admixing of at least one natural polymer, such as starch with particular preference, represents a particularly suitable embodiment. In the context of experiments it has additionally been found that a binder-pigment ratio within the interlayer of between 3:7 and 1:9, based in each case on the mass fraction in the interlayer, represents a particularly suitable embodiment.

In one particularly preferred aspect, the binder used in the interlayer comprises a mixture of styrene-butadiene latex and starch.

In-house studies have shown that the combination of styrene-butadiene latex and starch has a positive influence on the properties of the heat-sensitive recording material. When pure styrene-butadiene latex is used, the resulting heat-sensitive recording materials do exhibit very high binding. However, the pores of the calcined aluminum silicate become sealed by the styrene-butadiene latex. A surprising result of adding starch is that the interlayer also retains a high open porosity. Through the combination of styrene-butadiene latex and starch, therefore, an interlayer is obtained which exhibits very good binding and at the same time retains a high open porosity of the calcined aluminum silicate. The combination of styrene-butadiene latex and starch therefore leads to interlayers which cannot be obtained with each of the binders used alone.

Surprisingly it has emerged, moreover, that the properties of the interlayer comprising styrene-butadiene latex and starch can be improved still further if the interlayer comprises methylcellulose and/or a dispersing assistant.

In comparison to polyvinyl alcohol, styrene-butadiene latex has a substantially higher binding power and is therefore preferred. Styrene-butadiene latex is additionally preferred because it is not water-soluble and is no longer dissolved after the drying of the interlayer on application of the heat-sensitive recording layer.

Preferred in one aspect of the invention is a heat-sensitive recording material wherein the mass per unit area of the interlayer is in the range from 4.0 to 15.0 g/m$^2$, preferably in the range from 6.0 to 12.0 g/m$^2$, more preferably in the range from 7.0 to 10 g/m$^2$.

In-house studies have shown that particularly good results can be achieved if the interlayer is comparatively thick.

Preferred in one aspect of the invention is a heat-sensitive recording material wherein the dye precursor is selected from derivatives of compounds from the group consisting of fluoran, phthalide, lactam, triphenylmethane, phenothiazine, and spiropyran.

In-house studies have shown that these dye precursors exhibit particularly good properties in combination with the color developers or color developer mixture used in the invention.

One preferred heat-sensitive recording material of the invention comprises as dye precursors preferably compounds of the fluoran type selected from the group consisting of 3-diethylamino-6-methyl-7-anilinofluoran, 3-diethylamino-6-methyl-7-(3'-methylphenyl-amino)fluoran (6'-(diethylamino)-3'-methyl-2'-(m-tolylamino)-3H-spiro [isobenzofuran-1,9'-xanthen]-3-one; ODB-7), 3-di-n-pentylamino-6-methyl-7-anilinofluoran, 3-(diethylamino)-6-methyl-7-(3-methylphenylamino)fluoran, 3-di-n-butylamino-7-(2-chloroanilino)fluoran, 3-diethylamino-7-(2-chloroanilino)fluoran, 3-diethylamino-6-methyl-7-xylidinofluoran, 3-di-ethylamino-7-(2-carbomethoxyphenylamino)fluoran, 3-pyrrolidino-6-methyl-7-anilinofluoran, 3-pyrrolidino-6-methyl-7-(4-n-butyl-phenylamino)fluoran, 3-piperidino-6-methyl-7-anilinofluoran, 3-N-n-dibutylamine-6-methyl-7-anilinofluoran (ODB-2), 3-(N-methyl-N-cyclohexyl)amino-6-methyl-7-anilinofluoran, 3-(N-methyl-N-propyl)amino-6-methyl-7-anilinofluoran, 3-(N-methyl-N-tetrahydrofurfuryl) amino-6-methyl-7-anilinofluoran), 3-(N-ethyl-N-isoamyl) amino-6-methyl-7-anilinofluoran, 3-(N-ethyl-N-tolyl) amino-6-methyl-7-anilinofluoran, 3-(N-ethyl-N-tetrahydrofuryl)amino-6-methyl-7-anilinofluoran, 3-(N-ethyl-N-iso-pentylamino)-6-methyl-7-anilinofluoran, 3-(N-ethyl-4-toluidino)6-methyl-7-(4-toluidino)-fluoran, and 3-(N-cyclopentyl-N-ethyl)amino-6-methyl-7-anilinofluoran.

Likewise preferred are heat-sensitive recording materials of the invention which as dye precursors comprise the compounds stated in paragraphs [0049] to [0052] of EP 2 923 851 A1.

Particularly preferred in one aspect of the invention is a heat-sensitive recording material wherein the dye precursor is selected from the group consisting of 3-N-di-n-butylamine-6-methyl-7-anilinofluoran (ODB-2) and 3-(N-ethyl-N-isopentylamino)-6-methyl-7-anilinofluoran.

Preferred in one aspect of the invention is a heat-sensitive recording material wherein the heat-sensitive recording layer further comprises one or more constituents selected from the group consisting of binders, sensitizers, pigments, dispersants, antioxidants, release agents, defoamers, light stabilizers, and optical brighteners.

Preferred in one aspect of the invention is a heat-sensitive recording material wherein the heat-sensitive recording layer comprises a sensitizer.

When a sensitizer is used, the sensitizer is first melted during the supplying of heat in the course of the printing operation, and the melted sensitizer dissolves the color formers and color developers present alongside one another in the heat-sensitive recording layer and/or lowers the melting temperature of the color formers and color developers, to bring about a color development reaction. The sensitizer does not itself take part in the color development reaction.

A sensitizer therefore refers to substances which serve to adjust the melting temperature of the heat-sensitive recording layer and with which it is possible to set, preferably, a melting temperature of around 70 to 80° C., without the sensitizers themselves participating in the color development reaction.

Examples of sensitizers which can be used in the invention include fatty acid salts, fatty acid esters, and fatty acid amides (e.g., zinc stearate, stearamide, palmitamide, oleamide, lauramide, ethylene- and methylenebisstearamide, methylolstearamide) (preferably fatty acid amides each having a number of carbon atoms in the range from 16 to 24), fatty acid amide derivatives (e.g., N-(2-hydroxyethyl)octadecanamide, N-(hydroxymethyl)-octadecanamide), ethylene glycol m-tolyl ether, naphthalene derivatives, biphenyl derivatives, and phthalates and terephthalates.

Particularly preferred in the invention is a heat-sensitive recording material wherein the sensitizer is selected from the group consisting of 1,2-bis(3-methylphenoxy)ethane, 1,2-diphenoxyethane, 1,2-di(m-methylphenoxy)ethane, 2-(2H-benzotriazol-2-yl)-p-cresol, 2,2'-bis(4-methoxyphenoxy)diethyl ether, 4,4'-diallyloxydiphenyl sulfone, 4-acetylacetophenon, 4-benzylbiphenyl, acetoacidanilides, benzyl 2-naphthyl ether, benzyl naphthyl ether, benzyl 4-(benzyloxy)benzoate, benzyl paraben, bis(4-chlorobenzyl) oxalate ester, bis(4-methoxyphenyl) ether, dibenzyl oxalate, dibenzyl terephthalate, dimethyl terephthalate, dimethyl sulfone, diphenyl adipate, diphenyl sulfone, ethylenebisstearamide, fatty acid anilides, m-terpenyl, N-hydroxymethylstearamide, N-methylolstearamide, N-stearylurea, N-stearylstearamide, N-(2-hydroxyethyl)octadecanamide, N-(hydroxymethyl)octadecanamide, p-benzylbiphenyl, phenyl benzenesulfonate ester, salicylanilide, stearamide, ethylene glycol m-tolyl-ether and α,α'-diphenoxyxylene, particular preference being given to ethylene glycol m-tolyl ether, benzyl naphthyl ether, diphenyl sulfone, 1,2-di(m-methylphenoxy)ethane, and 1,2-diphenoxyethane.

In one particularly preferred aspect of the heat-sensitive recording material of the invention, the heat-sensitive recording layer comprises 1,2-diphenoxyethane, ethylene glycol m-tolyl ether, or a mixture of 1,2-diphenoxyethane and ethylene glycol m-tolyl ether as sensitizer.

In-house studies have shown that when 1,2-diphenoxyethane is used as sensitizer, it is possible to improve the resistance to lanolin and the heat-sensitive recording materials resistance at 90° C. in comparison with other sensitizers.

Likewise preferred are heat-sensitive recording materials of one aspect of the invention that comprise as sensitizer the compounds stated in paragraphs [0059] to [0061] of EP2923851A1.

According to a first preferred version, these sensitizers are each used alone, i.e., not in combination with the other stated sensitizers from the above list. According to a second, likewise preferred version, at least two sensitizers selected from the above list are incorporated into the heat-sensitive recording layer.

Preferred in one aspect of the invention is a heat-sensitive recording material wherein the sensitizer has a melting point of 60° C. to 180° C., preferably a melting point of 80° C. to 140° C.

Moreover, in the heat-sensitive recording materials of the invention, it may optionally prove useful to use 4,4'-diaminodiphenyl sulfone (4,4'-DDS, dapsone) as an additional additive in the heat-sensitive recording layer. The use of 4,4'-diaminodiphenyl sulfone in thermal papers is described for example in WO 2014/143174 A1. The invention may in this case then relate to a heat-sensitive recording material wherein 4,4'-diaminodiphenyl sulfone is present, especially additionally as an additive, in the heat-sensitive recording layer.

Likewise preferred are heat-sensitive recording materials wherein the heat-sensitive recording layer comprises a binder, preferably a crosslinked or noncrosslinked binder selected from the group consisting of polyvinyl alcohol, carboxyl-modified polyvinyl alcohol, ethylene-vinyl alcohol copolymer, a combination of polyvinyl alcohol and ethylene-vinyl alcohol copolymer, silanol group-modified polyvinyl alcohol, diacetone-modified polyvinyl alcohol, acrylate copolymer, and film-forming acrylic copolymers.

The coating material for forming the heat-sensitive recording layer of the heat-sensitive recording material of one aspect of the invention preferably comprises, as well as one or more binders, one or more crosslinking agents for the binder or binders. The crosslinking agent is preferably selected from the group consisting of zirconium carbonate, polyamideamine-epichlorohydrin resins, boric acid, glyoxal, dihydroxybis(ammonium lactato)titanium(IV) (CAS No. 65104-06-5; Tyzor LA) and gyloxal derivates.

A heat-sensitive recording material of one aspect of the invention whose heat-sensitive recording layer is formed from a coating material of this kind, comprising one or more binders and one or more crosslinking agents for the binder or binders, comprises in the heat-sensitive recording layer one or more binders crosslinked by reaction with one or more crosslinking agents, the crosslinking agent or agents being selected from the group consisting of zirconium carbonate, polyamideamine-epichlorohydrin resins, boric acid, glyoxal, dihydroxybis(ammonium lactato)titanium(IV) (CAS No. 65104-06-5; Tyzor LA) and gyloxal derivates. "Crosslinked binder" here refers to the reaction product formed by reaction of a binder with one or more crosslinking agents.

Preferred in one aspect of the invention is a heat-sensitive recording material wherein the mass per unit area of the heat-sensitive recording layer is in the range from 1.5 to 6 $g/m^2$, preferably in the range from 2.0 to 5.5 $g/m^2$, more preferably in the range from 2.0 to 4.8 $g/m^2$, more preferably still in the range from 2.5 to 3.5 $g/m^2$.

Likewise preferred in one aspect of the invention is a heat-sensitive recording material wherein the mass fraction of the color developer mixture in the heat-sensitive recording layer is 35 to 15%, preferably 31 to 19%, more preferably 28 to 22%, based on the total solids fraction of the heat-sensitive recording layer.

In recording materials of one aspect of the invention it is possible additionally to use image stabilizers, dispersants, antioxidants, release agents, defoamers, light stabilizers, and brighteners, of the kind known in the prior art. Each of the components is customarily used in an amount with a mass fraction of 0.01 to 15%, more particularly—except for defoamer—0.1 to 15%, preferably 1 to 10%, based on the total solids fraction of the heat-sensitive recording layer. When defoamers are used in the relevant formations, the defoamer may be present in the recording materials of the invention in amounts with a mass fraction of 0.03 to 0.05%, based on the total solids fraction of the heat-sensitive recording layer.

Preferred in one aspect of the invention are heat-sensitive recording materials of the invention that take the form of self-adhesive labels. The use of self-adhesive labels is very popular indeed in numerous applications. For example, postage stamps, parcel stickers, advertising labels, vehicle tax vignettes or price labels are available and used in the form of self-adhesive labels. Printable labels are likewise used very extensively in retail in order to price products which are self-weighed, or in public transportation—as luggage labels, for example.

Preference in one aspect of the invention is therefore given to a heat-sensitive recording material wherein a layer of adhesive is disposed on the reverse side of the substrate, facing away from the front side of the substrate.

Self-adhesive labels are furnished with a layer of adhesive enabling the self-adhesive label to stick to the desired site of use. Prior to the use of the self-adhesive label, the layer of adhesive is typically lined by a separate release paper, so that the layer of adhesive does not become contaminated or the self-adhesive label does not stick before the desired use. The use of a separate release paper is preferable especially in the case of precut labels. In the case of continuous labels on a roll, it is much more commonplace and also more practical in handling terms if the labels have coatings on their front side that are dehesive relative to the layers of adhesive on the reverse side. In this case, before they are used, the layers of adhesive on the reverse side are lined by the dehesive layers on the front side. Because the self-adhesive labels therefore serve as their own release paper, there is no need for a separate release paper, and so there is no disclosure of the release paper at the site of use. This technique has become established in particular with labels which are printed and used on site. Without release paper or a release layer, it would be difficult to store labels.

Preference in one aspect of the invention is given to a heat-sensitive recording material wherein on the heat-sensitive recording layer there is a release layer which is dehesive with respective to layers of adhesive, this release layer comprising at least one compound containing organosiloxane groups, or a wax.

A wax in the context of one aspect of this invention is understood to be a wax obtained by chemical modification of a vegetable oil. The chemical modification may entail, for example, a partial or complete hydration with a metallic catalyst, nickel for example, and hydrogen, with some or all of the double bonds of the oil being hydrated to single bonds. Unlike vegetable oils, the waxes are solid rather than liquid at 20° C. The chemical modification of the vegetable oil therefore brings about an increase in melting point.

A vegetable oil is understood to be a fatty acid triglyceride which is obtained from plants or parts of plants. The oil is obtained usually by pressing, extraction or refining of the oils from the plants or parts of plants. Obtaining the oils is familiar to the skilled person. Where plant seeds are used for oil production, they are referred to as oil seeds. The oil is present in the seeds in the form of lipids, which constitute the cell membrane and energy reserves of the seed. Depending on the fraction of unsaturated fatty acids in the oil, distinctions are made between nondrying (olive oil, for example), semidrying (soybean or rapeseed oil, for example), and drying (linseed or poppy oil, for example) oils. The term "drying" here refers not to evaporation, but rather to the solidification of the oil as a result of oxidation and polymerization of the unsaturated fatty acids. The use of semidrying and drying oils as starting material for producing the waxes used in one aspect of the invention is preferred.

Possible sources of vegetable oil are acai oil, algae oil, argan oil (from the fruits of the argan tree), avocado oil (from the fruit flesh of the avocado of the avocado tree), babacu oil, cottonseed oil (from the seeds of the cotton plant), borage oil or borage seed oil (from the seeds of the borage plant), cupuacu butter, cashewshell oil, safflower oil (from the seeds of the safflower or carthamus), peanut oil (from the fruit of the peanut plant), hazelnut oil (from hazelnuts from the hazelnut bush), hemp oil (from the seeds of edible hemp), jatropha oil (from the seeds of *Jatropha curcas*), jojoba oil (actually a liquid wax; from the seeds of the jojoba bush), camelia oil (from the seeds of *Camellia oleifera, Camellia sinensis* or *Camellia japonica*), cocoa butter, coconut oil (from the seed flesh of the coconut, the tree fruit of the coconut palm), pumpkin seed oil (also referred to as seed oil; from the seed kernels of the Styrain oil pumpkin), linseed oil (from ripe linseeds from flax), false flax oil (from the seeds of the false flax, Brassicaceae family), macadamia oil (from the nuts of the macadamia tree), maize kernel oil (from the kernels of maize), almond oil (from almonds from the almond tree), mango butter (from *Mangifera indica*), apricot kernel oil (from the apricot kernel—i.e., the almond of the apricot stone—the apricot), poppy seed oil (from the seed grains of poppy), evening primrose oil, olive oil (from the fruit flesh and kernel of the olive, the fruit of the olive tree), palm oil (from the fruit flesh of the palm fruit, the fruit of the oil palm), palm kernel oil (from the kernels of the palm fruit, the fruit of the olive palm), papaya oil, pistachio oil, pecan nut oil, perilla oil from the seeds of the perilla plant (shiso, sesame leaf), rapeseed oil (from the seeds of oil seed rape, Brassicaceae family), rice oil, castor oil (from the seeds of the castor oil plant), seed buckhorn oil (from the fruit flesh of the seed buckthorn berry, the fruit of the seed buckthorn bush), seed buckthorn kernel oil (from the kernels of the seed buckthorn berry, the fruit of the seed buckthorn bush), mustard oil (from the seed kernels of black mustard), black cumin oil (from the seeds of the fruit capsule of the black cumin plant), sesame oil (from the seeds of the sesame plant), shea butter (from the seeds of shea nut tree), soybean oil (from the beans of the soybean), sunflower oil (from the kernels of the sunflower), tung oil, walnut oil (from the kernels of the nuts from the walnut tree), watermelon seed oil, grapeseed oil (from the seeds of the fruits (grapes) of the grape plant or grape vine), wheatgerm oil (from the germs of wheat), and/or seeder oil (from the wood of the Lebanon seeder). This list should not be regarded as exclusive; it shows ways of obtaining vegetable oils that can be converted to a wax used in the invention.

It is preferred in one aspect of the invention if the wax is a wax based on an oil selected from the list encompassing palm oil, coconut oil, poppy seed oil, olive oil, linseed oil, soybean oil, sunflower oil, safflower oil, and rapeseed oil, the wax based on a vegetable oil preferably being a wax based on a soybean oil, i.e., soybean oil wax or soya wax.

Preferred in one aspect of the invention are waxes which have a melting point above 40° C., preferably above 50° C., more preferably above 60° C.

In-house studies have shown that very good results can be obtained just from using waxes having a melting point of above 20° C. It has surprisingly been possible to show, however, that when using waxes having a melting point of above 40° C., it is possible to boost the resistance of the release layer to mechanical load. This resistance is boosted still further at even higher melting points of the waxes. In-house studies have also shown that the optimum melting point of the waxes is in the range from 60 to 80° C., if the release layer is to be used at temperatures between 6° C. and 30° C. Where the release layer is also to be employed at higher temperatures, it may make sense to use a wax with a higher melting point.

Preferred in one aspect of the invention are release layers wherein the mass fraction of the wax in the release layer is 6 to 98%, preferably 20 to 90%, more preferably 50 to 89%, based on the total mass of the release layer.

It is preferred in one aspect of the invention if the release layer comprises not only the wax but also a polymeric binder, preferably a crosslinked or noncrosslinked binder selected from the group consisting of starch, polyvinyl alcohol, carboxyl-modified polyvinyl alcohol, ethylene-vinyl alcohol copolymer, a combination of polyvinyl alcohol and ethylene vinyl alcohol copolymer, ethylene-vinyl acetate copolymer, silanol group-modified polyvinyl alcohol, diacetone-modified polyvinyl alcohol, modified polyethylene glycol, unmodified polyethylene glycol, α-isodecyl-w-hydroxy-poly(oxy-1,2-ethanediyl), styrene-butadiene latex, styrene-acrylate polymers, acrylic copolymers, and mixtures thereof.

Where the release layer comprises a compound containing organosiloxane groups, it has emerged from various studies conducted in connection with the present invention that for the release layer a mass per unit area in a range from 0.5 $g/m^2$ to 3 $g/m^2$, preferably 0.8 $g/m^2$ to 1.85 $g/m^2$, more preferably 0.85 $g/m^2$ to 1.35 $g/m^2$ is established.

The heat-sensitive recording material here is preferably produced in such a way that parts of the compound containing organosiloxane groups, following the application of a coating composition comprising the compound containing organosiloxane groups, initially reside on the heat-sensitive recording layer, during which they partly penetrate or diffuse into the heat-sensitive recording layer, before the coating composition is crosslinked. As a result, a diffusion zone is formed which improves the adhesion of the two layers. The effect of this is that the dehesive release layer remains adhering on the heat-sensitive recording layer and does not detach.

It is preferred in one aspect of the invention here if the diffusion zone is formed by areal inward diffusion of parts at least of the compound containing organosiloxane groups from the coating composition containing the compound containing organosiloxane groups into the upper region—the region oriented toward the coating composition—of the heat-sensitive recording layer applied before the application of the coating composition, with a mass fraction of 1.5 to 50% of the entirety of the compound containing organosiloxane groups having diffused into the upper region of the heat-sensitive recording layer formed.

In order to influence the amount of the part diffused into the heat-sensitive recording layer, an important role is played by the binders and pigments incorporated preferably into the heat-sensitive recording layer. It has emerged on the one hand that it is very useful and therefore preferred if the heat-sensitive recording layer comprises at least one—preferably inorganic—pigment selected from the list encompassing natural kaolinite, calcined kaolinite, magnesium silicate hydrate (talc), calcium carbonate, and silicon dioxide (silica).

It is especially preferred here if the inorganic pigment in the heat-sensitive recording layer is platelet-shaped in form, as can be the case, for example, with kaolinite and talc. In the heat-sensitive recording layer, therefore, kaolinite and talc are particularly preferred. It is preferred more particularly if the inorganic, platelet-shaped pigment in the heat-sensitive recording layer (more particularly kaolinite and talc) has an aspect ratio of 5 to 100, preferably of 15 to 100, especially preferably of 20 to 100. In one preferred embodiment the aspect ratio of the inorganic pigment in the heat-sensitive recording layer is greater than 20.

With regard to the amount of pigment in the heat-sensitive recording layer, a range, based on the total mass of the heat-sensitive recording layer, with a mass fraction of 8 to 18% (bone-dry) is considered particularly suitable, this range being curtailed at the lower end by the increasing risk of possible deposits on the thermal print head, and toward the upper end by an increasing reduction in the sensitivity to the heat from the thermal print heads that produces the printed image.

Owing to the hydrophobic property of compound containing organosiloxane groups in the release layer, which diffuse into the heat-sensitive recording layer, it is considered to be preferable for the heat-sensitive recording layer to include at least one hydrophilic binder. Especially preferred in this context are binders selected from the list encompassing ethylene-vinyl acetate copolymer, polyvinyl alcohol, styrene-butadiene latex, styrene-acrylate latex, and starch.

It is preferred if the polyvinyl alcohol used as a binder of the heat-sensitive recording layer has a degree of hydrolysis of more than 99 mol % and a viscosity, measured according to DIN 53015 on an aqueous solution with 4 mass % at 20° C., of more than 7 mPas, preferably more than 12 mPas, more preferably more than 15 mPas. More particularly the polyvinyl alcohol (PVA) in question is a PVA 15-99 or a corresponding PVA having a higher degree of hydrolysis and/or higher viscosity than PVA 15-99.

In one preferred aspect of the present invention, the binder of the heat-sensitive recording layer comprises crosslinking (self-crosslinking or externally crosslinking) and/or modified polyvinyl alcohol, with the modified polyvinyl alcohol preferably being diacetone-modified polyvinyl alcohol, silanol group-modified polyvinyl alcohol or carboxyl-modified polyvinyl alcohol, preferably diacetone-modified polyvinyl alcohol or silanol group-modified polyvinyl alcohol.

Especially if a nonselfcrosslinking polyvinyl alcohol is used as binder, it is preferable in one preferred embodiment of one aspect of the present invention if the heat-sensitive recording layer comprises at least one crosslinking assistant selected from the list encompassing the following: boric acid, polyamine, epoxy resin, dialdehyde, formaldehyde oligomers, epichlorohydrin resin, adipic dihydrazide, dimethylurea, melamine-formaldehyde, alone or in a blend with one another.

In the sense of the present invention, ethylene-vinyl acetate copolymer, as sole binder or in conjunction with polyvinyl alcohol, is considered a particularly preferred binder, which, based on the total mass of the heat-sensitive recording layer, is incorporated in a range with a mass fraction of 10 to 20% into the heat-sensitive recording layer.

In one aspect of the heat-sensitive recording materials of the invention, the heat-sensitive recording layer is covered wholly or partly with a protective layer. As a result of the arrangement of a protective layer lining the heat-sensitive recording layer, the heat-sensitive recording layer is also shielded to the outside and/or to the carrier substrate of the next turn within a roll, so providing protection from external influences.

In such cases a protective layer of this kind, as well as protecting the heat-sensitive recording layer beneath the protective layer from environmental influences, often has the additional positive effect of improving the printability of the heat-sensitive recording material of the invention, especially in indigo printing, offset printing, and flexographic printing. For this reason it may be desirable for certain applications for the heat-sensitive recording material of one aspect of the invention to have a protective layer, despite the fact that the presence of a color developer mixture as defined above in the heat-sensitive recording layer of the heat-sensitive recording material of the invention means that the resistance of a thermal printout obtainable on a heat-sensitive recording material of one aspect of the invention with respect to substances selected from the group consisting of water, alcohols, fats, oils, and mixtures thereof is already sufficient even without a protective layer.

It is preferred in one aspect of the invention if the protective layer has a Bekk smoothness, determined according to DIN 53107:2016-05 (Title: Testing of Paper and Board—Determination of the smoothness by the Bekk method), of 350 to 1500 seconds, preferably of 400 to 1400 seconds.

In-house studies have shown that if the protective layer is present as topmost layer and has a Bekk smoothness of 350 to 1500 seconds or preferably of 400 to 1400 seconds, the heat-sensitive recording materials have particularly good properties. The high smoothness of the heat-sensitive recording material has the advantage—among others—of preserving the thermal head of the thermal printer. Moreover, smooth heat-sensitive recording materials have particularly good tactility and visual appearance and lead themselves particularly well to printing.

The protective layer of the heat-sensitive recording material of one aspect of the invention preferably comprises one or more crosslinked or noncrosslinked binders selected from the group consisting of polyvinyl alcohols modified with carboxyl groups, polyvinyl alcohols modified with silanol groups, diacetone-modified polyvinyl alcohols, partially and fully hydrolyzed polyvinyl alcohols, and film-forming acrylic copolymers.

Preferably, where present, the coating material for forming the protective layer of the heat-sensitive recording material of one aspect of the invention comprises, as well as one or more binders, one or more crosslinking agents for the binder or binders. In that case the crosslinking agent is preferably selected from the group consisting of boric acid, polyamines, epoxy resins, dialdehydes, formaldehyde oligomers, epichlorohydrin resins, adipic dihydrazide, melamine-formaldehyde, urea, methylolurea, ammonium zirconium carbonate, polyamide-epichlorohydrin resins, and dihydroxybis(ammonium lactato)titanium(IV) Tyzor LA (CAS No. 65104-06-5).

A heat-sensitive recording material of one aspect of the invention whose protective layer is formed from a coating material of this kind, comprising one or more binders and one or more crosslinking agents for the binder or binders, comprises in the protective layer one or more binders crosslinked by reaction with one or more crosslinking agents, the crosslinking agent or agents being selected from the group consisting of boric acid, polyamines, epoxy resins, dialdehydes, formaldehyde oligomers, epichlorohydrin resins, adipic dihydrazide, melamine-formaldehyde, urea, methylolurea, ammonium zirconium carbonate, polyamide-epichlorohydrin resins, and dihydroxybis(ammonium lactato)titanium(IV) Tyzor LA (CAS No. 65104-06-5). "Crosslinked binder" here refers to the reaction product formed by reaction of a binder with one or more crosslinking agents.

In a first variant version, the protective layer wholly or partly lining the heat-sensitive recording layer is obtainable from a coating material comprising one or more polyvinyl alcohols and one or more crosslinking agents. The polyvinyl alcohol of the protective layer is preferably modified with carboxyl groups or, in particular, silanol groups. Mixtures of different carboxyl-modified or silanol-modified polyvinyl alcohols can also be used with preference. A protective layer of this kind possesses high affinity for the preferably UV-crosslinking printing ink used in the offset printing process. This makes a decisive contribution to fulfilling the requirement for outstanding printability within offset printing.

The crosslinking agent or agents for the protective layer according to this variant version are preferably selected from the group consisting of boric acid, polyamines, epoxy resins, dialdehydes, formaldehyde oligomers, polyamine-epichlorohydrin resin, adipic dihydrazide, melamine-formaldehyde, and dihydroxybis(ammonium lactato)titanium(IV) Tyzor LA (CAS No. 65104-06-5). Mixtures of different crosslinking agents are also possible.

In the coating material for forming the protective layer according to this variant version, the mass ratio of the modified polyvinyl alcohol to the crosslinking agent is preferably in a range from 20:1 to 5:1 and more preferably in a range from 12:1 to 7:1. Particularly preferred is a ratio of the modified polyvinyl alcohol to the crosslinking agent in the range from 100 parts by mass to 8-11 parts by mass.

Particularly good results have been achieved if the protective layer according to this variant version additionally comprises an inorganic pigment. In that case the inorganic pigment is preferably selected from the group consisting of silicon dioxide, bentonite, boehmite, calcium carbonate, natural kaolin, calcined kaolin, and mixtures of the stated inorganic pigments.

The protective layer according to this variant version is preferably applied with a mass per unit area in a range from 1.0 g/m$^2$ to 6 g/m$^2$ and more preferably from 1.2 g/m$^2$ to 3.8 g/m$^2$. The protective layer here is preferably formed as a single layer.

In a second variant version, the coating material for forming the protective layer comprises as binder a water-insoluble, self-crosslinking acrylic polymer, a crosslinking agent, and a pigment constituent, the pigment constituent of the protective layer consisting of one or more inorganic pigments and being formed, at least with a mass fraction of 80%, of a highly purified, alkafied bentonite; the binder of the protective layer consisting of one or of two or more water-insoluble, self-crosslinking acrylic polymer(s); and the binder/pigment ratio being in a range from 7:1 to 9:1.

A self-crosslinking acrylic polymer within the protective layer in accordance with the second variant version described here is preferably selected from the group consisting of styrene-acrylate copolymers, copolymers of styrene and acrylate that contain acrylamide groups, and also copolymers based on acrylonitrile, methacrylamide, and acrylic ester. The latter are preferred. The pigment incorporated in the protective layer may be alkafied bentonite, natural or precipitated calcium carbonate, kaolin, silica, or aluminum hydroxide. Preferred crosslinking agents are selected from the group consisting of cyclic urea, methylolurea, ammonium zirconium carbonate, and polyamide-epichlorohydrin resins.

Through the choice of a water-insoluble, self-crosslinking acrylic polymer as binder and of the mass ratio thereof (i) to the pigment in a range from 7:1 to 9:1 and also (ii) to the crosslinking agent of greater than 5:1, the heat-sensitive recording material of the invention has high environmental resistance even in the case of a protective layer with a relatively low mass per unit area. Mass ratios of this kind are therefore preferred.

The protective layer itself can be applied using customary coating mechanisms, for which inter alia a coating color can be utilized, preferably with a mass per unit area in a range from 1.0 to 4.5 g/m$^2$. In an alternative variant, the protective layer has been applied by printing. Protective layers of this kind curable by using actinic radiation are particularly suitable on the basis of their processing and technological properties. The term "actinic radiation" is to be understood as meaning UV or ionizing radiations, such as electron beam rays.

The appearance of the protective layer is critically determined by the type of smoothing and of the cylinder surfaces which influence the friction in the smoothing mechanism and calender, and by the materials of said surfaces. Existing commercial requirements in particular are the reason why a roughness (Print Surf roughness) for the protective layer of less than 1.5 μm (determined in accordance with ISO standard 8791, Part 4) is deemed preferable. Having been found particularly useful in the context of experimental work preceding this invention was the use of smoothing mechanisms employing NipcoFlex or zone-regulated Nipco-P cylinders; however, the invention is not restricted to these.

Preference in the invention is given to a heat-sensitive recording material wherein the substrate is or comprises paper, synthetic paper, cardboard, paperboard or polymeric film.

Although not confined to paper as the substrate, the substrate which has established itself on the market, with a view among other things to high environmental compatibility, paper, and here especially a coating base paper that has not been surface treated, is preferred in the sense of the invention, on account of the high recyclability. A coating base paper which has not been surface treated means a coating base paper which has not been treated in a sizing press or in a coating apparatus. Equally possible as web-form substrate for the invention are films of, for example, polypropylene, polyolefin, and polyolefin-coated papers, without any such observation being exclusive in nature.

In one aspect of the present invention, the heat-sensitive recording material comprises or consists of a substrate, having a front side and a reverse side opposite the front side, the substrate being or comprising paper, a heat-sensitive recording layer disposed to the front side of the web-form substrate, said heat-sensitive recording layer comprising at least one dye precursor and at least one color developer which is reactive with said dye precursor and which is a compound of the formula (II) depicted below (II)

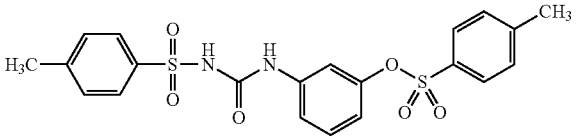

and comprises no color developer of the depicted formula (I)

(I)

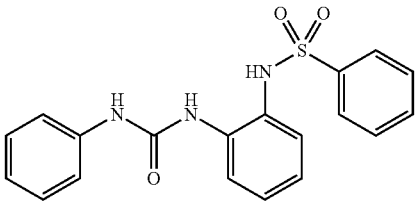

and an interlayer disposed between the substrate and the heat-sensitive recording layer and comprising calcined aluminum silicate, the mass fraction of the calcined aluminum silicate in the interlayer being 60 to 75%, based on the total mass of the solids fractions in the interlayer, wherein the calcined aluminum silicate is platelet-shaped and has an aspect ratio of 5 to 95, wherein the interlayer comprises a styrene-butadiene latex, starch, and methylcellulose, wherein the heat-sensitive recording layer comprises 1,2-diphenoxyethane and/or benzyl naphthyl ether, and wherein the mass per unit area of the interlayer is in the range from 4.0 to 15.0 g/m$^2$, preferably in the range from 6.0 to 12.0 g/m$^2$, more preferably in the range from 7.0 to 10 g/m$^2$, and the mass per unit area of the heat-sensitive recording layer is in the range from 1.5 to 6 g/m$^2$, preferably in the range from 2.0 to 5.5 g/m$^2$, more preferably in the range from 2.0 to 4.8 g/m$^2$.

In one aspect of the present invention, the heat-sensitive recording material comprises or consists of a substrate, having a front side and a reverse side opposite the front side, the substrate being or comprising paper, a heat-sensitive recording layer disposed to the front side of the web-form substrate, said heat-sensitive recording layer comprising at least one dye precursor and at least one color developer which is reactive with said dye precursor and which is a compound of the formula (I) depicted below (I)

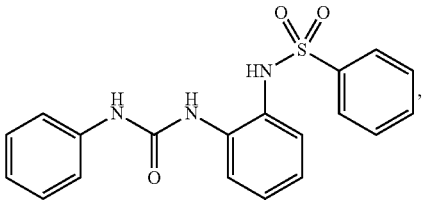

where the compound of the formula (I) is in a crystalline form which in the IR spectrum has an absorption band at 3401±20 cm$^{-1}$, and comprises no color developer of the depicted formula (I)

(II)

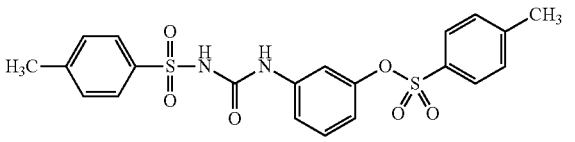

and an interlayer disposed between the substrate and the heat-sensitive recording layer and comprising calcined aluminum silicate, the mass fraction of the calcined aluminum silicate in the interlayer being 60 to 75%, based on the total mass of the solids fractions in the interlayer, wherein the calcined aluminum silicate is platelet-shaped and has an aspect ratio of 5 to 95, wherein the interlayer comprises a styrene-butadiene latex, starch, and methylcellulose, wherein the heat-sensitive recording layer comprises 1,2-diphenoxyethane and/or benzyl naphthyl ether, and wherein the mass per unit area of the interlayer is in the range from 4.0 to 15.0 g/m$^2$, preferably in the range from 6.0 to 12.0 g/m$^2$, more preferably in the range from 7.0 to 10 g/m$^2$, and the mass per unit area of the heat-sensitive recording layer is in the range from 1.5 to 6 g/m$^2$, preferably in the range from 2.0 to 5.5 g/m$^2$, more preferably in the range from 2.0 to 4.8 g/m$^2$.

In one aspect of the present invention, the heat-sensitive recording material comprises or consists of a substrate, having a front side and a reverse side opposite the front side, the substrate being or comprising paper, a heat-sensitive recording layer disposed to the front side of the web-form substrate, said heat-sensitive recording layer comprising at least one dye precursor and at least one color developer which is reactive with said dye precursor and which is a compound of the formula (II) depicted below

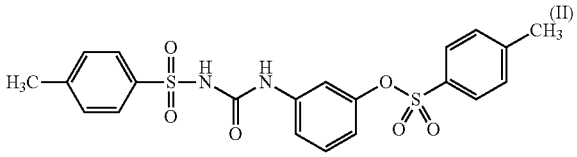

(II)

and comprises a color developer of the depicted formula (I)

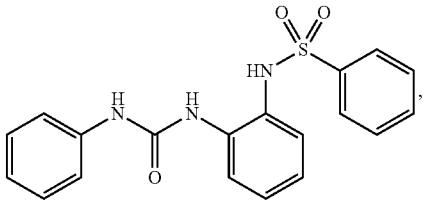

(I)

where the compound of the formula (I) is in a crystalline form which in the IR spectrum has an absorption band at 3401±20 $cm^{-1}$, and an interlayer disposed between the substrate and the heat-sensitive recording layer and comprising calcined aluminum silicate, the mass fraction of the calcined aluminum silicate in the interlayer being 60 to 75%, based on the total mass of the solids fractions in the interlayer, wherein the calcined aluminum silicate is platelet-shaped and has an aspect ratio of 5 to 95, wherein the interlayer comprises a styrene-butadiene latex, starch, and methylcellulose, wherein the heat-sensitive recording layer comprises 1,2-diphenoxyethane and/or benzyl naphthyl ether, and wherein the mass per unit area of the interlayer is in the range from 4.0 to 15.0 $g/m^2$, preferably in the range from 6.0 to 12.0 $g/m^2$, more preferably in the range from 7.0 to 10 $g/m^2$, and the mass per unit area of the heat-sensitive recording layer is in the range from 1.5 to 6 $g/m^2$, preferably in the range from 2.0 to 5.5 $g/m^2$, more preferably in the range from 2.0 to 4.8 $g/m^2$.

A further aspect of one aspect of the present invention relates to products, preferably entry tickets, TITO tickets (Ticket-in, Ticket-out), flight, rail, ship or bus ticket, gaming coupon, parking display ticket, label, till receipt, bank statements, self-adhesive label, medical and/or technical diagram paper, fax paper, security paper, or barcode labels, comprising a heat-sensitive recording material of one aspect of the invention.

A further aspect of one aspect of the present invention is the use of a heat-sensitive recording material of the invention as a barcode label, self-adhesive ticket, self-adhesive entry ticket, self-adhesive proof of purchase, self-adhesive label, self-adhesive entry ticket, entry ticket, TITO tickets (Ticket-in, Ticket-out), flight, rail, ship or bus ticket, gaming coupon, parking display ticket, label, till receipt, bank statement, medical and/or technical diagram paper, fax paper or security paper.

A further aspect of the present invention relates to a method for producing a heat-sensitive recording material, preferably a heat-sensitive recording material of the invention, comprising the following steps:

providing or producing a substrate comprising a front side and a reverse side disposed opposite to the front side, providing or producing a first coating composition, said first coating composition comprising calcined aluminum silicate, applying the first coating composition to the front side of the substrate, drying and/or crosslinking the applied first coating composition, to form at least one interlayer, providing or producing a second coating composition, the second coating composition comprising at least one dye precursor and at least one color developer which is reactive with this dye precursor and which a) is a compound of the formula (I) depicted below

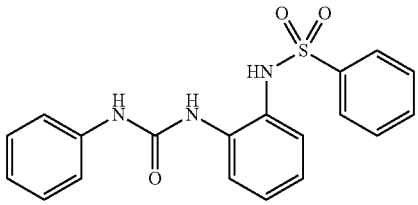

(I)

or b) is a compound of the formula (II) depicted below

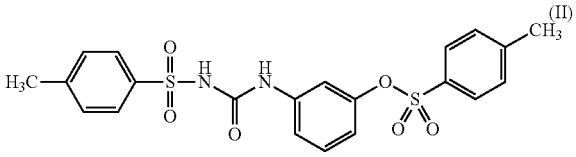

(II)

or c) is a mixture comprising the compound of the formula (I) and the compound of the formula (II)

applying the second coating composition to the at least one interlayer, drying and/or crosslinking the applied second coating composition, to give a heat-sensitive recording layer.

Preference in one aspect of the invention is given to a method which additionally comprises the following steps:

providing or producing an adhesive coating composition which comprises at least one adhesive or adhesive precursor, applying the adhesive coating composition to the reverse side of the substrate, opposite from the front side, and optionally drying and/or crosslinking the applied adhesive coating composition, to form a layer of adhesive.

Preference in one aspect of the invention is given to a method which additionally comprises the following steps:

providing or producing an interlayer coating composition, applying the interlayer coating composition to the heat-sensitive recording layer, and drying and/or crosslinking the applied interlayer coating composition, to form a second interlayer.

Preference in one aspect of the invention is given to a method which additionally comprises the following steps:

providing or producing a protective layer coating composition, applying the protective layer coating composition to the heat-sensitive recording layer, and drying and/or crosslinking the applied protective layer coating composition, to form a protective layer.

Preference in one aspect of the invention is given to a method which additionally comprises the following steps:

providing or producing a release layer coating composition, said release layer coating composition comprising at least one compound containing organosiloxane groups, or a wax, applying the release layer coating composition to the heat-sensitive recording layer or to the second interlayer, drying and/or crosslinking the applied release layer coating composition, to form a release layer which is dehesive to adhesives.

As far as preferred embodiments and combinations are concerned for a coating composition used in a method of the invention, the explanations given above for the heat-sensitive recording materials of the invention are valid correspondingly (where appropriate, mutatis mutandis), and vice-versa.

The term "coating composition" in the context of the present invention and in agreement with the general understanding in the field of paper technology refers to coating materials comprising or consisting of pigments and/or matrix pigments, binders, and additives, which are applied to ("coated") the paper surface or to layers already applied to paper surfaces, using special-purpose coating apparatuses, to finish or modify the surface of the paper. Papers produced in this way are referred to as "coated papers" and are notable for example for improved tactility. The term "coating composition" is therefore the generic term for all spreadable coating materials, preparations and/or solutions in the paper industry for the treatment, modification or finishing of a paper surface.

To apply the coating composition to a carrier substrate or an interlayer, the skilled person knows of various coating techniques, examples being the following: blade coating, film press coating, cast coating, curtain coating, knife coating, airbrush coating, or spray coating. All of these known coating technologies identified above are suitable for applying the coating compositions of the invention to a substrate, preferably to paper which comprises one or more precoats and/or intermediate coats, or else which comprises no precoat or intercoat.

A further aspect of the present invention relates to a use of calcined aluminum silicate in an interlayer of a heat-sensitive recording material, the heat-sensitive recording material, besides the interlayer, comprising or consisting of the following components:

a substrate, the substrate having a front side and a reverse side disposed opposite to the front side, and a heat-sensitive recording layer disposed to the front side of the web-form substrate, said heat-sensitive recording layer comprising at least one dye precursor and at least one color developer which is reactive with this dye precursor and which a) is a compound of the formula (I) depicted below (I)

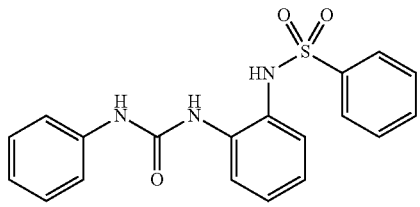

or b) is a compound of the formula (II) depicted below (II)

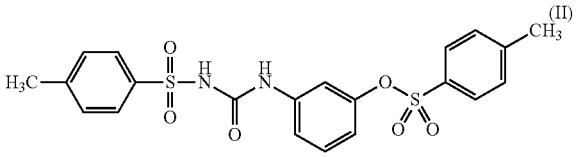

or c) is a mixture comprising the compound of the formula (I) and the compound of the formula (II), and wherein the interlayer is disposed between the substrate and the heat-sensitive recording layer, and wherein the mass fraction of the calcined aluminum silicate in the interlayer is 50 to 90%, based on the total mass of the solids fractions in the interlayer.

In the context of one aspect of the present invention, preferably two or more of the aspects identified above as being preferred are actualized at the same time; especially preferred are the combinations of such aspects, and of the corresponding features, that emerge from the appended claims.

DETAILED DESCRIPTION OF THE PRESENTLY PREFERRED EMBODIMENTS

Figure 1:
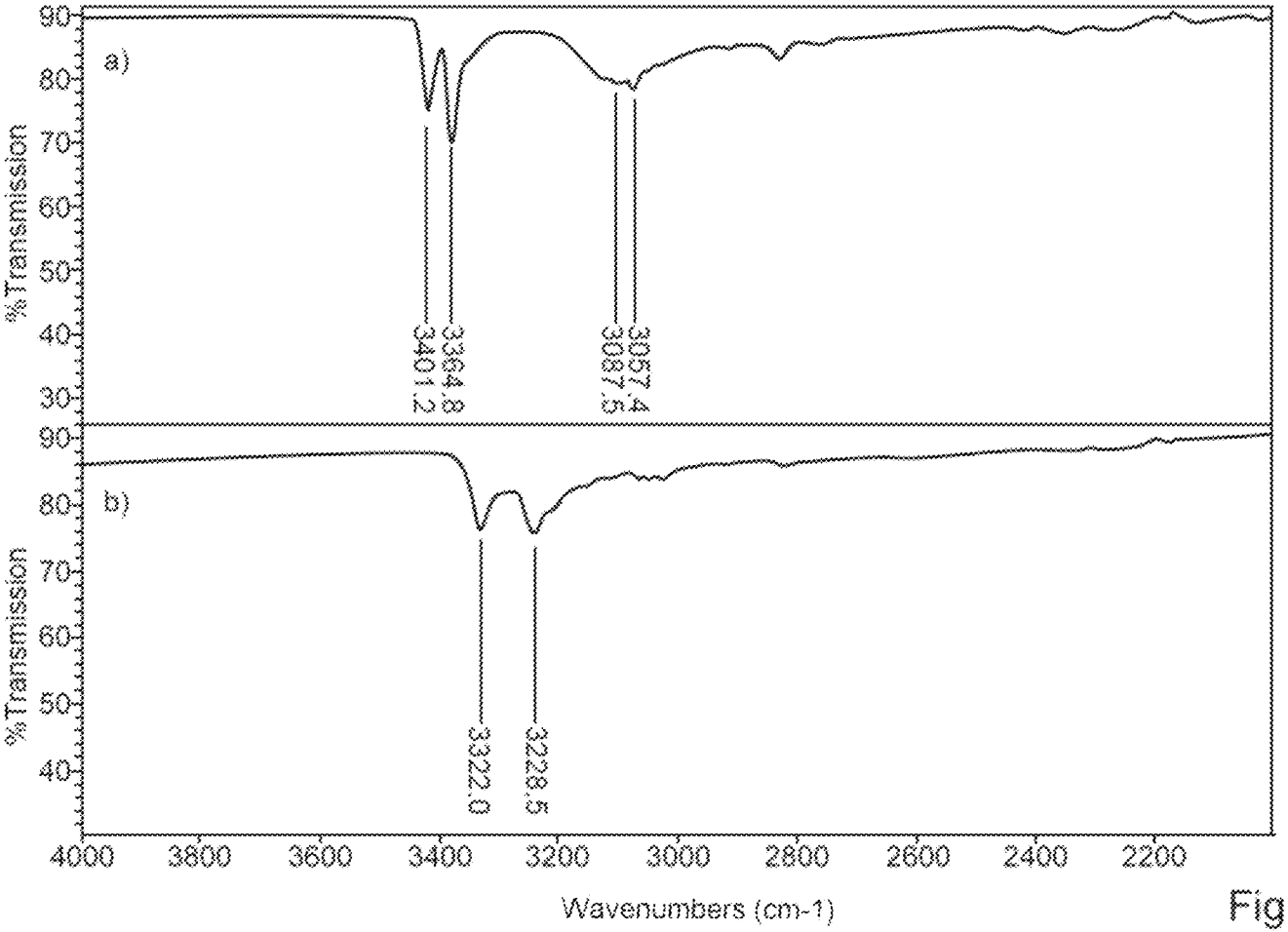
FIG. 1 is a comparison of IR spectra in the wavenumber range from around 4000 to 2000 $cm^{-1}$ of the two crystalline forms of the compound of the formula (I)
Figure 2:
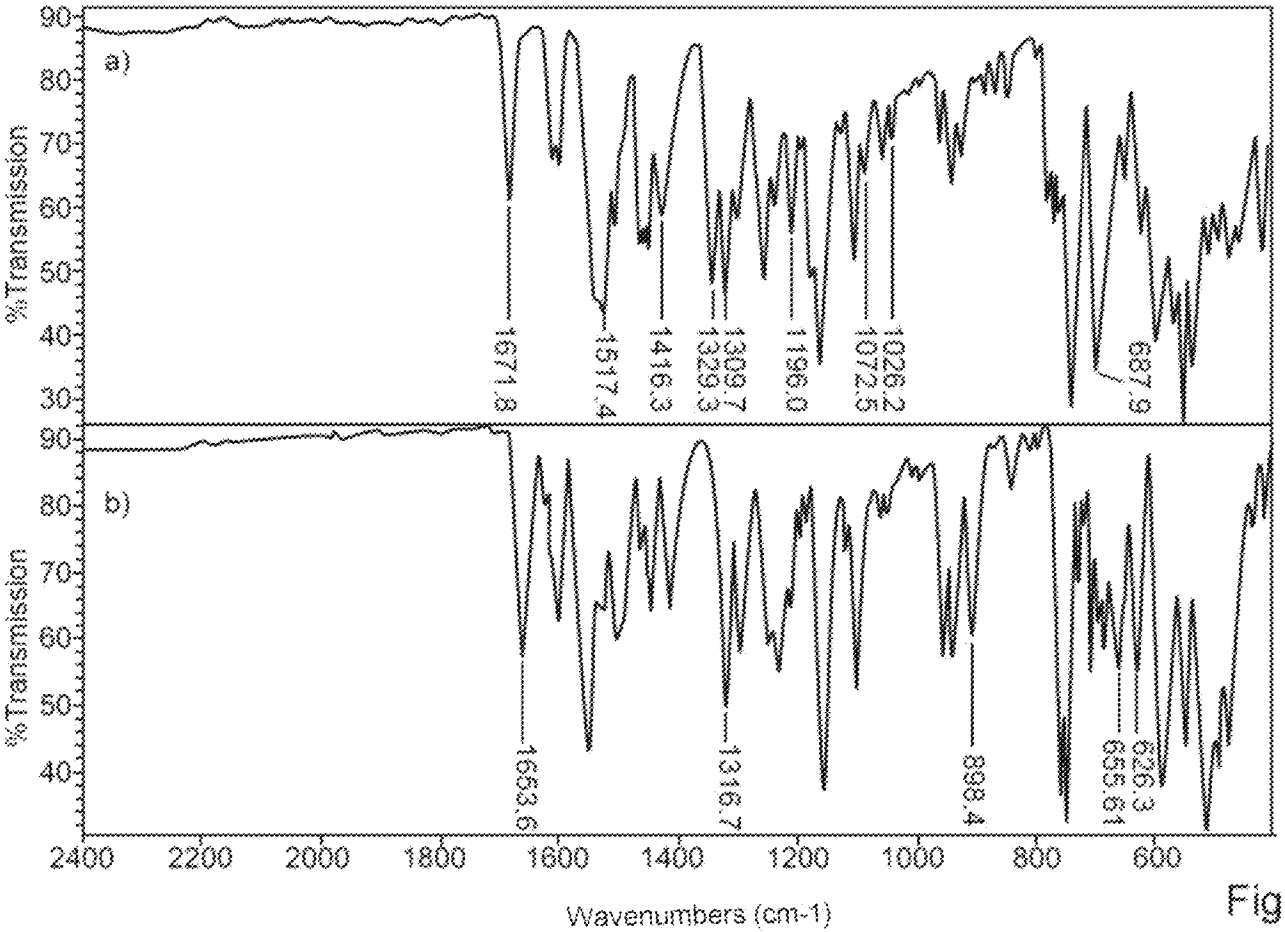
FIG. 2 is a comparison of IR spectra in the wavenumber range from around 2400 to 400 $cm^{-1}$ of the two crystalline forms of the compound of the formula (I)
Figure 3:
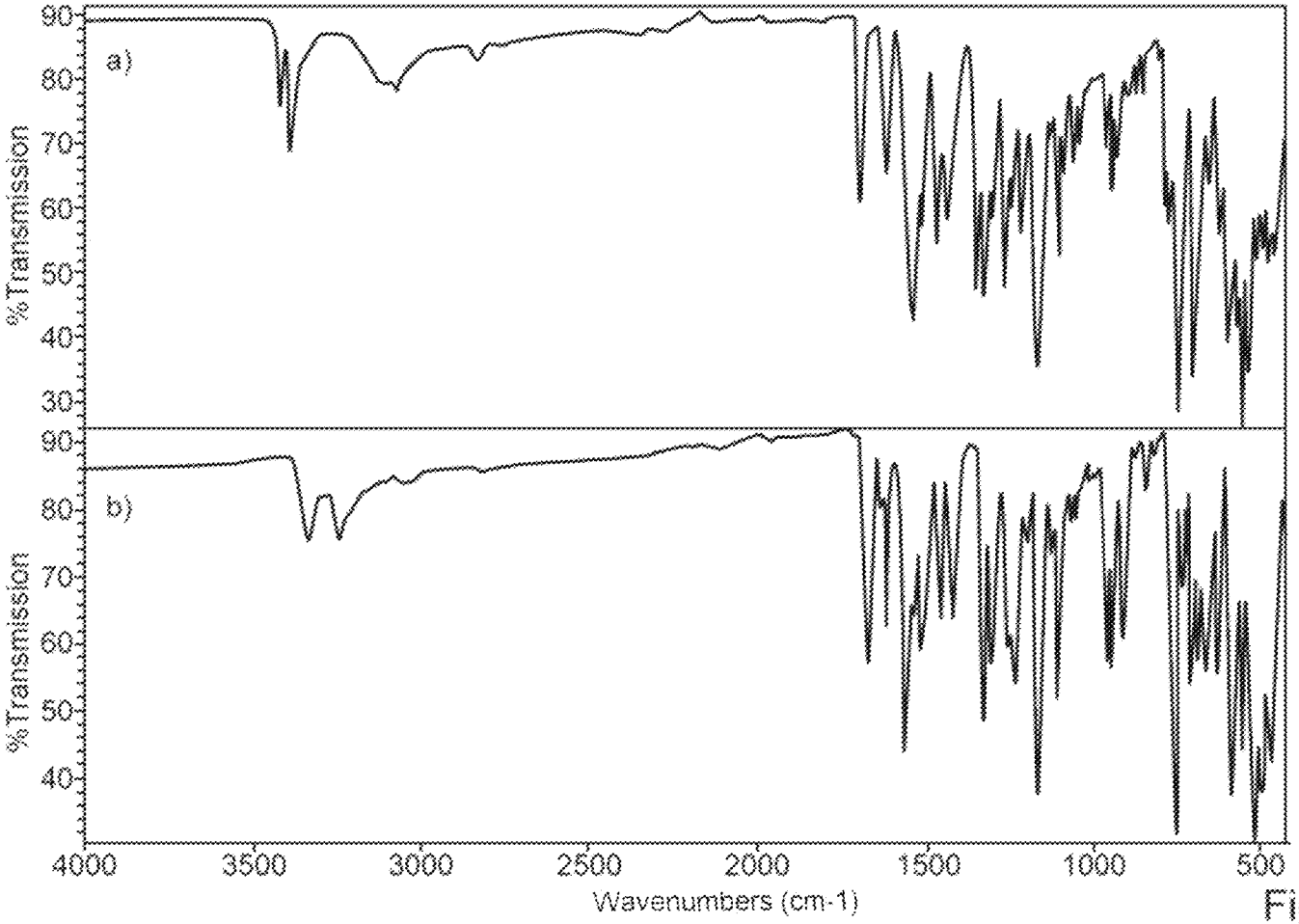
FIG. 3 is a comparison of IR spectra of the two crystalline forms of the compound of the formula (I)

The appended FIGS. 1, 2, and 3 are graphic reproductions (fine drawings) of machine-generated original spectra.

FIG. 1 shows a comparison of IR spectra in the wavenumber range from around 4000 to 2000 $cm^{-1}$ of the two crystalline forms of the compound of the formula (I).

Depicted in the upper part and identified with a) is the IR spectrum of the crystalline form of the compound of the formula (I) used in the invention and having a melting point of 175° C. Depicted in the lower part and identified with b) is the IR spectrum of the crystalline form of the compound of the formula (I) used in the invention and having a melting point of around 158° C.

FIG. 2 shows a comparison of IR spectra in the wavenumber range from around 2400 to 400 $cm^{-1}$ of the two crystalline forms of the compound of the formula (I). Depicted in the upper part and identified with a) is the IR spectrum of the crystalline form of the compound of the formula (I) used in the invention and having a melting point of 175° C. Depicted in the lower part and identified with b) is the IR spectrum of the crystalline form of the compound of the formula (I) used in the invention and having a melting point of around 158° C.

FIG. 3 shows a comparison of IR spectra of the two crystalline forms of the compound of the formula (I). Depicted in the upper part and identified with a) is the IR spectrum of the crystalline form of the compound of the formula (I) used in the invention and having a melting point of 175° C. Depicted in the lower part and identified with b) is the IR spectrum of the crystalline form of the compound of the formula (I) used in the invention and having a melting point of around 158° C.

The inventive and comparative examples below provide further elucidation of the invention:

Inventive Example 1

The web-form substrate used is a base paper having a mass per unit area of 64 $g/m^2$, produced on a Fourdrinier paper machine from bleached and ground hard wood and soft wood pulps, with addition, based on the total solids content (bone dry) of the pulp supplied to the paper machine, of AKD size with a mass fraction of 0.8%, as a stop sizing, and also with addition of other customary adjuvants.

In papermaking a distinction is made between three levels for the solids content of paper and pulp: "bone dry" (absolutely dry), "air dry", and "oven dry". This is reported in each case in "% bone dry", "% air dry", and "% oven dry". Here, "bone dry" represents a paper or pulp with 0% water content. The basis used for the calculation for "air dry" is a "standard" moisture content (that which is basically necessary for the paper). In the case of chemical and mechanical pulp, the calculation mass is based in general on 90:100, i.e., 90 parts of pulp and 10 parts of water. The condition of paper or pulp after drying under specified, defined conditions is referred to as "oven dry".

Applied to the front side is an interlayer with a mass per unit area of 9 $g/m^2$, using a coating knife, the interlayer comprising the following composition in percentage mass fractions:

83% of calcined aluminum silicate as pigment,

12% of styrene-butadiene latex as binder, 2.5% of starch as cobinder, and 2.5% of further auxiliaries (biocide 0.05%, dispersant 0.35%, methylcellulose 0.2%, thickener 0.2%).

Applied to this interlayer comprising calcined aluminum silicate, by means of a roller knife coating device, is a heat-sensitive recording layer, with a mass per unit area of 3.2 $g/m^2$. The aqueous coating material used for this purpose contains the following components, according to the formula reproduced in table 1:

TABLE 1

| Amounts in mass fractions [%] (bone dry), based on the total mass of the heat-sensitive recording layer | | |
|---|---|---|
| Dye precursor | 3-dibutylamino-6-methyl-7-anilinofluoran (ODB-2) | 9 |
| Color developer | N-(p-toluenesulfonyl)-N'-3-(p-toluenesulfonyloxyphenyl)urea (Pergafast 201 (BASF)) | 20 |
| Sensitizer | benzyl 2-naphthyl ether (BNE) | 16 |
| Binder | polyvinyl alcohol-co-ethylene copolymer (EVOH) | 15 |
| Cobinder | acrylate copolymer | 10 |
| | methylcellulose | 2 |
| Pigment | talc (platelet-shaped with an aspect ratio of 25) | 16 |
| | | 88 |

Further constituents of the heat-sensitive recording layer, which are not stated in percentage terms and based on the total mass in mass fractions [%] (bone dry), include dispersants, defoamers, optical brighteners, thickeners, waxes, and crosslinkers.

Following the application of the heat-sensitive recording layer, it is dried and calendered, and here a value of 500 Bekk/sec according to DIN 53107:2016-05 (Title: Testing of Paper and Board—Determination of the smoothness by the Bekk method) is measured for the front-side surface smoothness.

The web-form substrate produced, with interlayer and heat-sensitive recording layer, is coated on the front side (to the heat-sensitive recording layer) with a radically curing standard UV silicone system, using a patterned roll applicator. The solvent-free Evonik standard silicone system used for this purpose comprises a formulation which is reproduced in table 2. The silicone add-on here is around 1.2 $g/m^2$.

TABLE 2

| | |
|---|---|
| RC-711 silicone acrylate | 25 mass fractions |
| RC-902 silicone acrylate | 50 mass fractions |
| RC-1772 silicone acrylate (mixture with dulling agent) | 25 mass fractions |
| TEGO photoinitiator A-18 | 2 mass fractions |

The furnish thus obtained, comprising release agent, is cured with a UV lamp (80 W/cm) under a protective gas atmosphere of nitrogen.

This gives a heat-sensitive recording material of one aspect of the invention wherein the release layer, comprising compounds containing organosiloxane groups, does not detach from the heat-sensitive recording layer. Even after storage for 30 days, the release layer comprising release agent cannot be detached from the heat-sensitive recording layer. The sensitivity of the recording material produced is good.

Inventive Example 2

Inventive example 1 was repeated, except that the compound used as color developer, rather than N-(p-toluenesulfonyl)-N'-3-(p-toluenesulfonyloxyphenyl) urea (Pergafast 201 (BASF)) was the compound N-[2-(3-phenylureido) phenyl]benzenesulfonamide (NKK) having a melting point of 178° C.

Inventive Example 3

A layer of adhesive was produced on the reverse side of the substrate of the heat-sensitive recording layer produced in inventive example 1, by application of a polyacrylic resin adhesive.

The substrate was subsequently rolled up, causing the layer of adhesive to lie on the release layer comprising a compounds containing organosiloxane groups. Even after storage for 30 days, individual plies of the heat-sensitive recording material can be unrolled, without the release layer comprising release agent detaching from the heat-sensitive recording layer, or residues of the layer of adhesive remaining on the release layer comprising a release agent.

Inventive Example 4

A layer of adhesive was produced on the reverse side of the substrate of the heat-sensitive recording layer produced in inventive example 2, by application of a polyacrylic resin adhesive.

The web-form substrate was subsequently rolled up, causing the layer of adhesive to lie on the release layer comprising a compounds containing organosiloxane groups. Even after storage for 30 days, individual plies of the heat-sensitive recording material can be unrolled, without the release layer comprising release agent detaching from the heat-sensitive recording layer, or residues of the layer of adhesive remaining on the release layer comprising a release agent.

Comparative Example 1

Inventive example 1 was repeated, but the pigment used in the interlayer comprised hollow-body pigments (particle size: 1.5 μm) instead of the calcined aluminum silicate.

Comparative Example 2

Inventive example 3 was repeated, but the pigment used in the interlayer comprised hollow-body pigments (particle size: 1.5 μm) instead of the calcined aluminum silicate.

Figure 4:
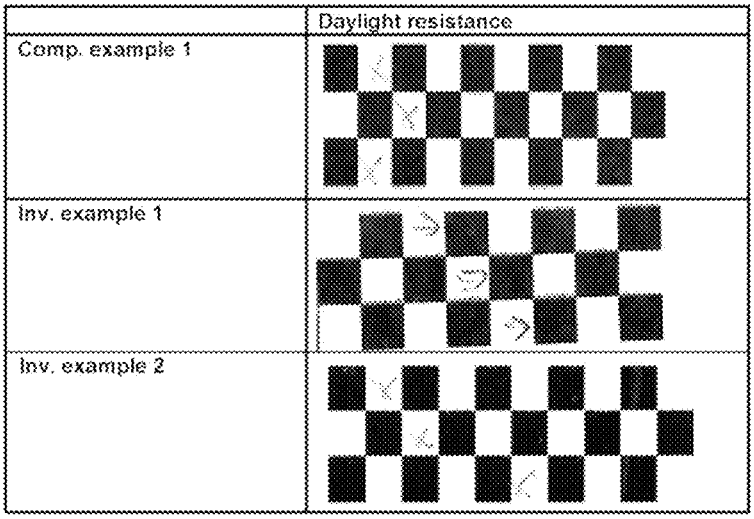
FIG. 4 shows daylight resistance of the examples.
Figure 5:
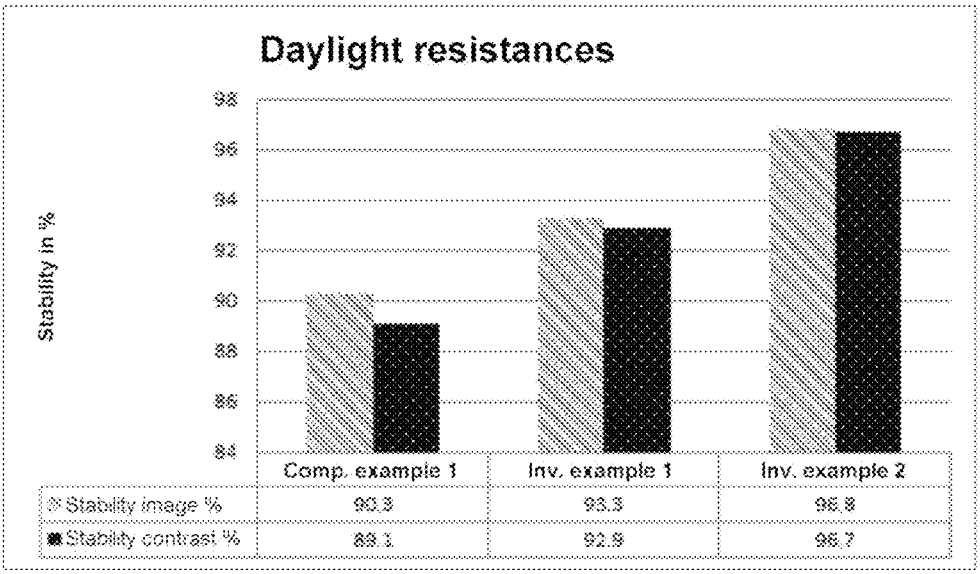
FIG. 5 is a graph of daylight resistance.

The daylight resistance was determined on the heat-sensitive recording materials from inventive examples 1 and 2 and also from comparative example 2. The heat-sensitive recording material from inventive example 1 shows an improvement in stability of around 3% (stability of the image and of the contrast) relative to the heat-sensitive recording material from comparative example 1, and the heat-sensitive recording material from inventive example 2 shows an improvement in stability of around 7% (stability of the image and of the contrast) relative to the heat-sensitive recording material from comparative example 1. The results are reproduced in FIGS. 4 and 5.

Determination of the Resistance of Heat-Sensitive Recording Materials in Daylight:

The daylight resistance was determined on the heat-sensitive recording materials from inventive examples 1 and 2 and also from comparative example 2.

For the metrological capture of the daylight resistance of a thermal printout on the heat-sensitive recording materials of inventive examples 1 and 2 and of comparative example 1, test thermal printouts of black/white checkered design were produced on each of the heat-sensitive recording materials under test, using an Atlantek Model 400 "Thermal Response Test System" from Global Media Instruments, LLC (USA), employing a thermal head with a resolution of 300 dpi and an energy per unit area of 16 mJ/mm$^2$.

Following the production of the test thermal printout with black and white checkering, and after a rest time of more than 5 minutes, a determination of the print density was carried out at each of three locations on the black-colored areas and the uncolored areas of the test thermal printout, by a TECHKON SpectroDens Advanced—spectral densitometer. The mean was formed in each case from the respective measurement values on the black-colored areas and the uncolored areas.

A test thermal printout was irradiated for 24 hours using a daylight lamp with an energy of 21 600 kJ/m$^2$. After 24 hours, the thermal paper printout was removed and, again, a determination of the print density was carried out at each of three locations on the black-colored areas and the uncolored areas of the test thermal printout, by a TECHKON SpectroDens Advanced—spectral densitometer. The mean was formed in each case from the respective measurement values on the black-colored areas and the uncolored areas.

The resistance of the printed image in % corresponds to the ratio between the mean formed of the print density of the colored areas before and after storage under the daylight lamp, multiplied by 100.

The heat-sensitive recording material from inventive example 1 shows an improvement in stability of around 3% (stability of the image and of the contrast) relative to the heat-sensitive recording material from comparative example 1, and the heat-sensitive recording material from inventive example 2 shows an improvement in stability of around 7% (stability of the image and of the contrast) relative to the heat-sensitive recording material from comparative example 1. The results are reproduced in FIGS. 4 and 5.

Determination of the Resistance of Heat-Sensitive Recording Materials (at 90° C. for One Hour):

For the metrological capture of the resistance of a thermal printout on the heat-sensitive recording materials of inventive examples 1 and 2 and of comparative example 1, test thermal printouts of black/white checkered design were produced on each of the heat-sensitive recording materials under test, using an Atlantek Model 400 "Thermal Response Test System" from Global Media Instruments, LLC (USA), employing a thermal head with a resolution of 300 dpi and an energy per unit area of 16 mJ/mm$^2$.

Following the production of the test thermal printout with black and white checkering, and after a rest time of more than 5 minutes, a determination of the print density was carried out at each of three locations on the black-colored areas and the uncolored areas of the test thermal printout, by a TECHKON SpectroDens Advanced—spectral densitometer. The mean was formed in each case from the respective measurement values on the black-colored areas and the uncolored areas.

A test thermal printout was suspended in a conditioning cabinet at 90° C. After one hour, the thermal paper printout was removed and cooled to room temperature and, again, a determination of the print density was carried out at each of three locations on the black-colored areas and the uncolored areas of the test thermal printout, by a TECHKON SpectroDens Advanced—spectral densitometer. The mean was formed in each case from the respective measurement values on the black-colored areas and the uncolored areas.

The resistance of the printed image in % corresponds to the ratio between the mean formed of the print density of the colored areas before and after storage in the conditioning cabinet, multiplied by 100.

Figure 6:
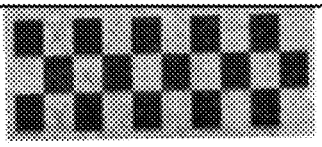
FIG. 6 shows temperature resistance of the examples.
Figure 6:
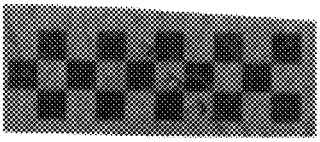
Figure 6:
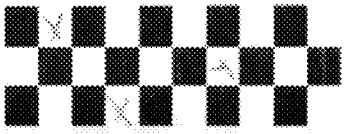
Figure 7:
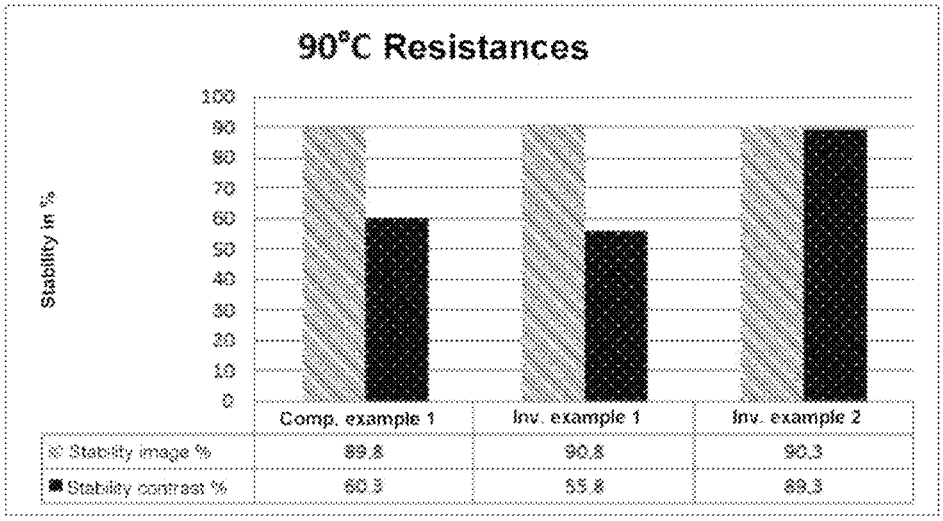
FIG. 7 is a graph of temperature resistance.

The heat-sensitive recording material from inventive example 1 shows an improvement in the image stability of around 1% relative to the heat-sensitive recording material from comparative example 1, and the heat-sensitive recording material from inventive example 2 shows an improvement in background stability of around 7% (stability of the contrast) relative to the heat-sensitive recording material from comparative example 1. The results are reproduced in FIGS. 6 and 7.

Figure 9:
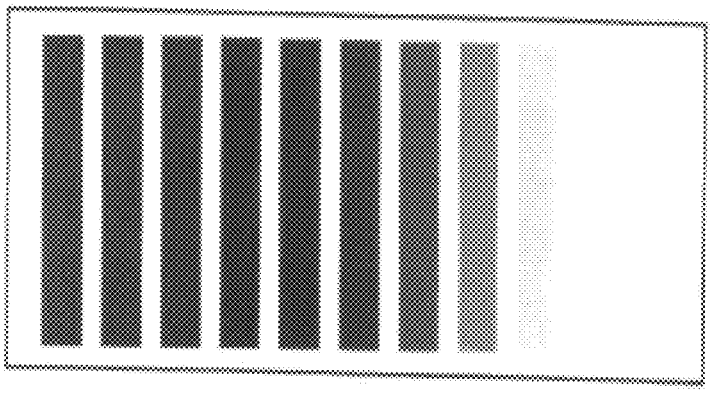
FIG. 9 is a print image for the assessment of dynamic print density on a heat-sensitive recording material of the present invention.
Figure 10:
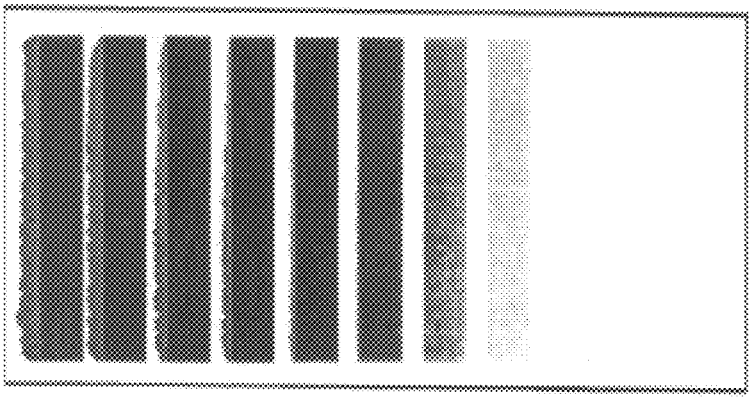
FIG. 10 is a print image for the assessment of dynamic pressure density on material not according to the present invention.

In comparison with the heat-sensitive recording materials from inventive example 1 and comparative example 1, shown in FIG. 9, the recording material from inventive example 2 shows no background graying at all. The background image remains absolutely white.

Determination of the Dynamic Print Density:

For the metrological capture of the dynamic print density of a thermal printout on the heat-sensitive recording materials of inventive examples 1 and 2 and of comparative example 1, ten rectangles each with different energy inputs were printed on each of the heat-sensitive recording materials under test. The test thermal printouts were made using an Atlantek Model 400 "Thermal Response Test System" from Global Media Instruments, LLC (USA). Employed in this case was a thermal head with a resolution of 300 dpi, and an energy per unit area of 3.22, 4.62, 6.07, 7.49, 8.88, 10.32, 11.74, 13.17, 14.57, and 16.00 mJ/mm$^2$.

Following the production of the test thermal printout, and after a rest time of more than 5 minutes, a determination of the print density was carried out at each of three locations on each of the black-colored areas of the test thermal printout, by a TECHKON SpectroDens Advanced—spectral densitometer. The mean was formed in each case from the respective measurement values on the black-colored areas.

Figure 8:
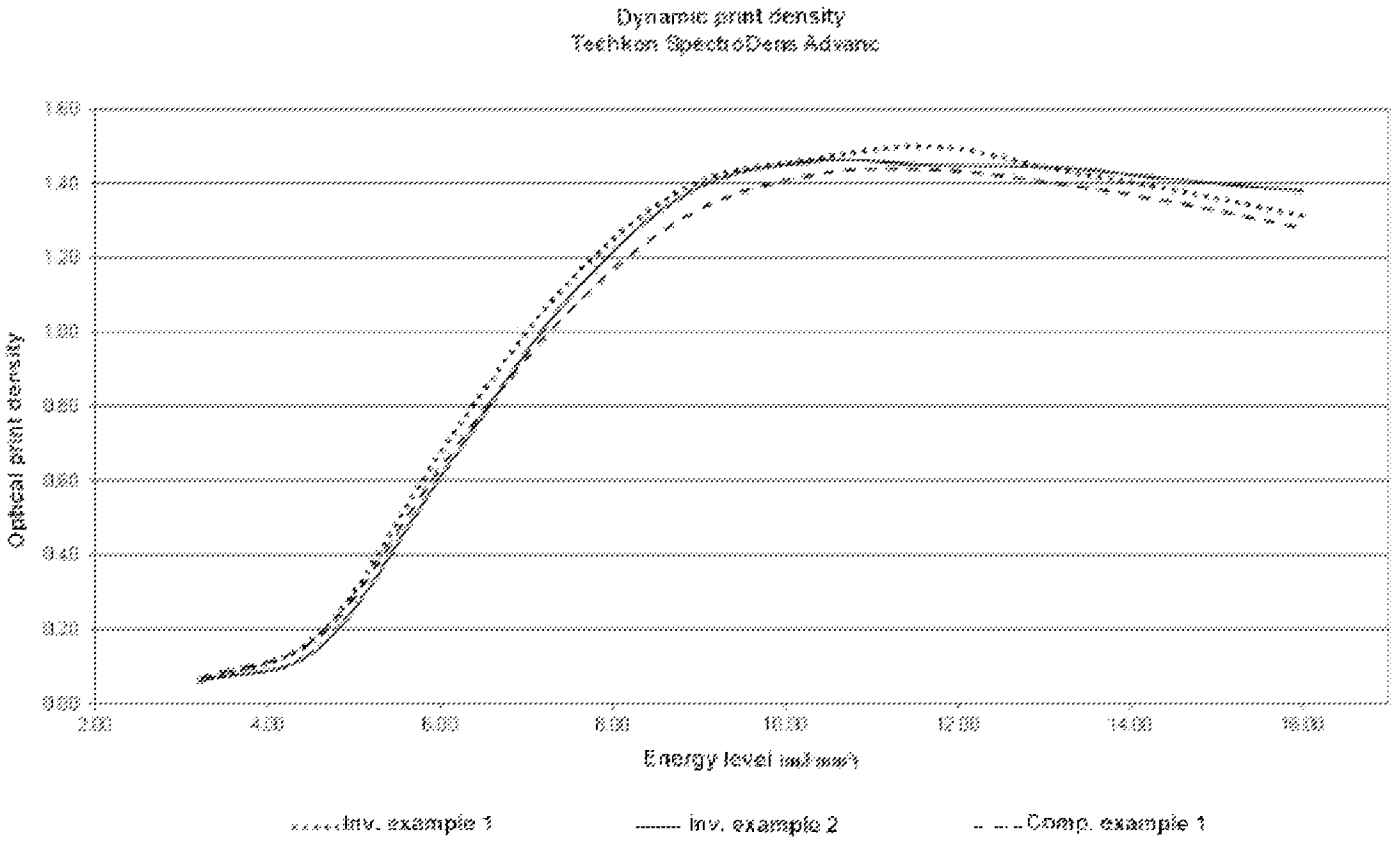
FIG. 8 is a graph of dynamic print density.

The dynamic print density was determined on the heat-sensitive recording materials from inventive examples 1 and 2 and also from comparative example 2. At higher energies (from around 7 mJ/mm$^2$), the heat-sensitive recording materials from inventive examples 1 and 2 display a higher print density (sensitivity) than the material from comparative example 2. Moreover, the materials display a higher maximum print density (Dmax) and a higher print density at higher energies (16 mJ/mm$^2$). The results are reproduced in table 3 below and in FIG. 8.

TABLE 3

| | 3.22 (mJ/mm$^2$) | 4.62 (mJ/mm$^2$) | 6.07 (mJ/mm$^2$) | 7.49 (mJ/mm$^2$) | 8.88 (mJ/mm$^2$) | 10.32 (mJ/mm$^2$) | 11.74 (mJ/mm$^2$) | 13.17 (mJ/mm$^2$) | 14.57 (mJ/mm$^2$) | 16.00 (mJ/mm$^2$) |
|---|---|---|---|---|---|---|---|---|---|---|
| Inventive example 1 | 0.06 | 0.19 | 0.70 | 1.14 | 1.39 | 1.47 | 1.50 | 1.44 | 1.38 | 1.31 |
| Inventive example 2 | 0.06 | 0.16 | 0.64 | 1.09 | 1.38 | 1.46 | 1.45 | 1.44 | 1.41 | 1.38 |
| Comparative example 1 | 0.07 | 0.19 | 0.66 | 1.06 | 1.32 | 1.42 | 1.44 | 1.40 | 1.35 | 1.28 |

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material comprising:

a substrate, which is a web-form substrate, having a front side and a reverse side opposite the front side;

a heat-sensitive recording layer disposed on the front side of the web-form substrate, the heat-sensitive recording layer comprising:

at least one dye precursor; and at least one color developer that is reactive with the at least one dye precursor and is a) a compound of a formula (I):

(I)

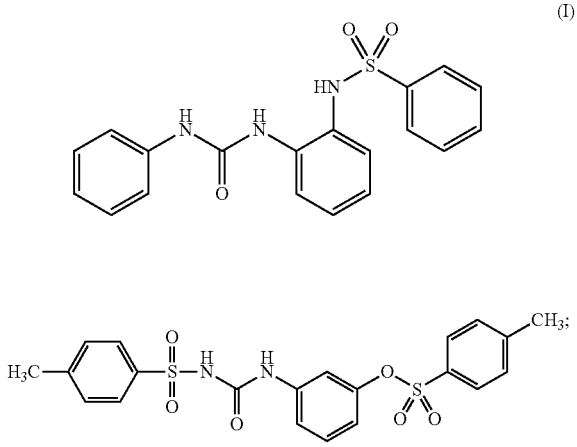

an interlayer disposed between the substrate and the heat-sensitive recording layer and comprising calcined aluminum silicate; and a mass fraction of the calcined aluminum silicate in the interlayer being 50 to 90%, based on a total mass of solids in the interlayer, wherein the compound of the formula (I) is in a crystalline form in which an IR spectrum has an absorption band at 3401±20 cm$^{-1}$.

2. The heat-sensitive recording material as claimed in claim 1, wherein the calcined aluminum silicate in the interlayer is platelet-shaped.

3. The heat-sensitive recording material as claimed in claim 2, wherein the platelet-shaped, calcined aluminum silicate has an aspect ratio of at least one of:

3 to 100.

4. The heat-sensitive recording material as claimed in claim 1, wherein the at least one color developer consists of the compound of the formula (I).

5. The heat-sensitive recording material as claimed in claim 1, wherein the heat-sensitive recording layer further comprises a sensitizer.

6. The heat-sensitive recording material as claimed in claim 1, wherein the heat-sensitive recording layer further comprises a sensitizer and the sensitizer is selected from the group consisting of 1,2-bis(3-methylphenoxy)ethane, 1,2-diphenoxyethane, 1,2-di(m-methylphenoxy)ethane, 2-(2H-benzotriazol-2-yl)-p-cresol, 2,2'-bis(4-methoxyphenoxy)diethyl ether, 4,4'-diallyloxydiphenyl sulfone, 4-acetylacetophenone, 4-benzylbiphenyl, acetoacidanilides, benzyl 2-naphthyl ether, benzyl naphthyl ether, benzyl 4-(benzyloxy)benzoate, benzyl paraben, bis(4-chlorobenzyl) oxalate ester, bis(4-methoxyphenyl) ether, dibenzyl oxalate, dibenzyl terephthalate, dimethyl terephthalate, dimethyl sulfone, diphenyl adipate, diphenyl sulfone, ethylenebisstearamide, fatty acid anilides, m-terpenyl, N-hydroxymethylstearamide, N-methylolstearamide, N-stearylurea, N-stearylstearamide, N-(2-hydroxyethyl)octadecanamide, N-(hydroxymeth-yl)octadecanamide, p-benzylbiphenyl, phenyl benzenesulfonate ester, salicylanilide, stearamide, ethylene glycol m-tolyl ether, and α,α'-diphenoxyxylene.

7. The heat-sensitive recording material as claimed in claim 1, wherein the heat-sensitive recording layer further comprises a sensitizer and the sensitizer is 1,2-diphenoxyethane or benzyl naphthyl ether.

8. The heat-sensitive recording material as claimed in claim 1, wherein the heat-sensitive recording layer has a Bekk smoothness as determined to DIN 53107:2016-05 is:

100 to 1200 seconds.

9. The heat-sensitive recording material as claimed in claim 1, wherein a mass per unit area of the interlayer is in a range of:

from 4.0 to 15.0 g/m$^2$, and a mass per unit area of the heat-sensitive recording layer is in a range of:

from 1.5 to 6 g/m$^2$.

10. The heat-sensitive recording material as claimed in claim 1, wherein the mass fraction of the calcined aluminum silicate in the interlayer is 60 to 90%, based on the total mass of solids in the interlayer.

11. The heat-sensitive recording material as claimed in claim 1, wherein the mass fraction of the calcined aluminum silicate in the interlayer is 65 to 75%, based on the total mass of solids in the interlayer.

12. The heat-sensitive recording material as claimed in claim 1, wherein the interlayer further comprises:

one or more constituents selected from the group consisting of biocides, binders, dispersants, release agents, defoamers, thickeners, and optical brighteners.

13. The heat-sensitive recording material as claimed in claim 1, wherein the interlayer comprises at least one dispersant.

14. The heat-sensitive recording material as claimed in claim 13, wherein the at least one dispersant is a sodium polyacrylate homopolymer.

15. The heat-sensitive recording material as claimed in claim 1, wherein the interlayer comprises at least one of a styrene-butadiene latex, starch, and methyl cellulose.

16. The heat-sensitive recording material as claimed in claim 1, wherein the substrate comprises one or more of paper, synthetic paper, cardboard, paperboard, and polymeric film.

17. The heat-sensitive recording material as claimed in claim 1, wherein the heat-sensitive recording layer further comprises one or more constituents selected from the group consisting of binders, sensitizers, pigments, dispersants, antioxidants, release agents, defoamers, light stabilizers, and optical brighteners.

18. The heat-sensitive recording material as claimed in claim 1, further comprising:

a protective layer at least partially covering the heat-sensitive recording layer.

19. The heat-sensitive recording material as claimed in claim 1, further comprising:

a layer of adhesive disposed on the reverse side of the substrate, facing away from the front side of the substrate.

20. The heat-sensitive recording material as claimed in claim 1, further comprising:

a release layer disposed on the heat-sensitive recording layer and that is dehesive toward layers of adhesive.

21. The heat-sensitive recording material as claimed in claim 20, wherein the release layer comprises at least one compound containing organosiloxane groups or a wax.

22. The heat-sensitive recording material as claimed in claim 1, wherein the heat-sensitive recording material can be part of a product, an entry ticket, a flight ticket, a rail, a ship ticket, a bus ticket, a gaming coupon, a parking display ticket, a label, a till receipt, a bank statement, a self-adhesive label, a medical diagram paper, fax paper, securing paper, or a barcode label.

23. The heat-sensitive recording material as claimed in claim 1, which can be used in at least one of a barcode label, a self-adhesive ticket, a self-adhesive entry ticket, a self-adhesive proof of purchase, a self-adhesive label, a self-adhesive entry ticket, an entry ticket, a flight ticket, a rail ticket, a ship ticket, a bus ticket, a gaming coupon, a parking display ticket, a label, a till receipt, a bank statement, a medical diagram paper, fax paper, or security paper.

24. The heat-sensitive recording material as claimed in claim 1, further comprising:

a compound of formula (II):

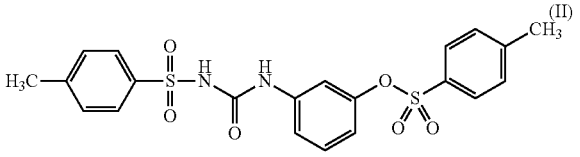

wherein the compound of the formula (II) is present as a color developer and there is a mixture comprising the compound of the formula (I) and the compound of the formula (II).

25. A method for producing a heat-sensitive recording material, comprising:

providing or producing a substrate comprising a front side and a reverse side disposed opposite to the front side;

providing or producing a first coating composition, the first coating composition comprising calcined aluminum silicate;

applying the first coating composition to the front side of the substrate;

drying and/or crosslinking the applied first coating composition, to form at least one interlayer;

providing or producing a second coating composition, the second coating composition comprising at least one dye precursor and at least one color developer which is reactive with this dye precursor and which a) is a compound of a formula (I):

(I)

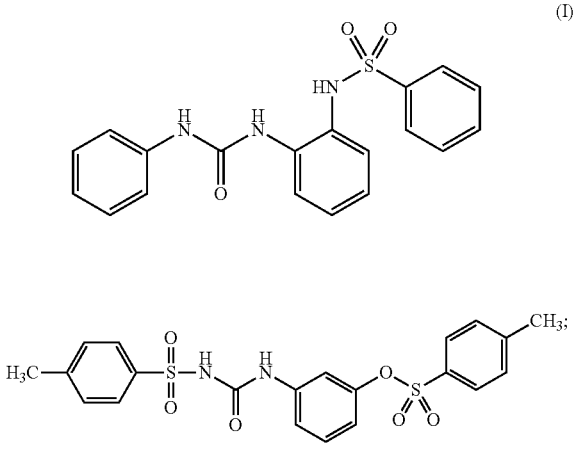

applying the second coating composition to the at least one interlayer; and drying and/or crosslinking the applied second coating composition, to give a heat-sensitive recording layer, wherein the compound of the formula (I) is in a crystalline form in which an IR spectrum has an absorption band at 3401±20 $cm^{-1}$.

26. The method for producing a heat-sensitive recording material, as claimed in claim 25, further comprising:

providing or producing a release layer coating composition, the release layer coating composition comprising at least one compound containing at least one of organosiloxane groups or a wax;

applying the release layer coating composition to the heat-sensitive recording layer;

drying and/or crosslinking the applied release layer coating composition to form a release layer that is dehesive with respect to adhesives.

27. The method as claimed in claim 25, wherein a compound of formula (II) is present as a color developer and there is a mixture comprising the compound of the formula (I) and the compound of the formula (II):

wherein the compound of formula (II) is:

(II)

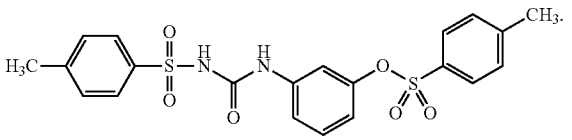

28. A heat-sensitive recording material comprising:

a substrate, the substrate having a front side and a reverse side disposed opposite to the front side; and a heat-sensitive recording layer disposed to a front side of the substrate, the heat-sensitive recording layer comprising at least one dye precursor and at least one color developer which is reactive with the at least one dye precursor and which is a) a compound of a formula (I):

(I)

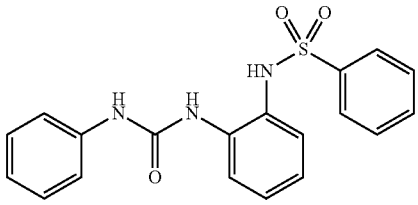

an interlayer disposed between the substrate and the heat-sensitive recording layer comprising calcined aluminum silicate, and wherein a mass fraction of the calcined aluminum silicate in the interlayer is 65 to 75%, based on a total mass of solids in the interlayer, wherein the compound of the formula (I) is in a crystalline form in which an IR spectrum has an absorption band at 3401±20 $cm^{-1}$.

29. The heat-sensitive recording material as claimed in claim 28, further comprising:

a compound of formula (II):

(II)

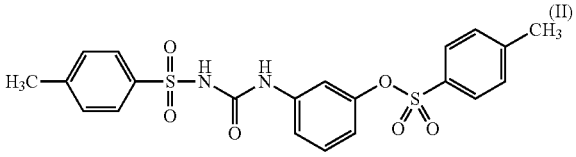

wherein the compound of the formula (II) is present as a color developer and there is a mixture comprising the compound of the formula (I) and the compound of the formula (II).

* * * * *